US007552966B2

(12) United States Patent
Crowell

(10) Patent No.: US 7,552,966 B2
(45) **Date of Patent: *Jun. 30, 2009**

(54) COLLAPSIBLE PORTABLE PLATFORM

(76) Inventor: Robert L. Crowell, 177 Weaver St., Boone, NC (US) 28607

( * ) Notice: Subject to any disclaimer, the term of this patent is extended or adjusted under 35 U.S.C. 154(b) by 55 days.

This patent is subject to a terminal disclaimer.

(21) Appl. No.: 12/007,974

(22) Filed: Jan. 17, 2008

(65) Prior Publication Data

US 2008/0111401 A1 May 15, 2008

Related U.S. Application Data

(63) Continuation-in-part of application No. 11/448,744, filed on Jun. 8, 2006, now Pat. No. 7,370,908.

(60) Provisional application No. 60/688,380, filed on Jun. 8, 2005.

(51) Int. Cl.
*A47C 4/00* (2006.01)

(52) U.S. Cl. ..... 297/51; 297/16.2; 248/164; 108/118

(58) Field of Classification Search ..... 297/16.1, 297/16.2, 344.18, 51; 108/118; 248/164
See application file for complete search history.

(56) References Cited

U.S. PATENT DOCUMENTS

| | | | |
|---|---|---|---|
| 105,222 | A | 7/1870 | King |
| 402,709 | A | 5/1889 | Abbott |
| 772,316 | A | 10/1904 | Mock |
| 1,205,057 | A | 11/1916 | Sulenski |
| 1,240,119 | A | 9/1917 | Burns |
| 3,084,896 | A | 4/1963 | Alexiou |
| 3,376,069 | A | 4/1968 | Lowdermilk |
| 3,414,323 | A | 12/1968 | Mitchum |
| 4,266,748 | A | 5/1981 | Dalton |
| D282,320 | S | 1/1986 | Anderson |
| 4,810,029 | A | 3/1989 | Kaladis et al. |
| 4,934,638 | A | 6/1990 | Davis |
| 5,709,428 | A | 1/1998 | Hugghins |
| 6,125,769 | A | 10/2000 | Tsai et al. |
| 6,634,704 | B1 | 10/2003 | Bergquist |
| 6,676,208 | B2 | 1/2004 | Lu |
| 6,871,905 | B2 | 3/2005 | Grace |

OTHER PUBLICATIONS

Campmor, Camp Time Roll-a-Chair, Item No. 41193; www.campmor.com.
Campmor; TravelChair Ultimate Slacker Travel Chair, Item No. 46810; www.campmor.com.

*Primary Examiner*—Anthony D Barfield

(57) ABSTRACT

A portable platform usable as a seat having at least three outwardly-inclined legs and a seat supported thereby is provided. The legs have nestable sections, an uppermost portion of each leg being attachable to an underside of the platform. The legs are maintained in biased relationship by an elastic cord or cable which extends between the platform and a lowermost section of the legs. The elastic cord or cable extends through each section of the legs, and is tensioned such that the sections may be separated from one another and folded onto an uppermost surface of said platform for storage. An extendable back-supporting member is also provided.

30 Claims, 22 Drawing Sheets

COLLAPSIBLE PORTABLE PLATFORM

CROSS-REFERENCE TO RELATED APPLICATION

This application claims priority under 35 USC 120 as a continuation-in-part application of application Ser. No. 11/448,744, filed Jun. 8, 2006, now U.S. Pat. No. 7,370,908 published as Publication No. 2007/0013211 on Jan. 18, 2007, which claims priority under 35 USC 119(e) of provisional application No. 60/688,380, filed Jun. 8, 2005.

BACKGROUND OF THE PRESENT INVENTION

Many types of portable stools or platforms are known in the art. See, for example, U.S. Design Pat. No. 282,320; and U.S. Pat. Nos. 105,222; 402,709; 1,205,057; 1,240,119; 3,084,896; 3,376,069; 3,414,323; 4,266,748; 4,810,029; 4,934,638; 5,709,428; 6,125,769; 6,676,208; and 6,871,905. Several of the disclosed designs are more portable than others.

However, a need exists for a portable seat or platform which folds into a size such that the folded seat or platform may be carried in a pocket or fanny pack.

A need further exists for a portable foldable seat or platform which is comfortable to sit upon, as well as exhibiting such strength that it may support up to 400 lbs.

A need still further exists for a portable seat that includes a dimensionally-stable seat portion, which preferably swivels in use.

A need also exists for a portable seat that includes a back support.

SUMMARY OF THE PRESENT INVENTION

The present invention is thus directed to a collapsible portable platform.

The portable platform has at least three legs and can be used as a stool, chair, seat, table, etc.

The platform is comprised of a folding top portion which serves as a platform, and at least three folding legs that can be folded onto the uppermost portion of the foldable top portion, with sections of the top portion folding proportionally inwardly to accept the folded legs in an encompassing storage position.

The legs are comprised of connectable sections which are caused to be biased in connective relationship by an elastic cord or cable extending from the bottom of the platform and fixed to a bottommost leg portion of each of the at least three outwardly-inclined legs. The elastic cord or cable may also be further extendable from the underside of said platform along the exterior of the legs, each of the legs including on an outside surface thereof means to removably engage (such as by a loop in the cord or cable) the elastic cord or cable when in an extended state whereby, such that when the elastic cord or cable is removably engaged with the outside surface of each respective leg, the legs are caused to be biased toward the platform when in biased relationship to one another.

The legs may be removably attached to the underside of the platform by various means, such as by being removably inserted upon post-like members extending from the underside of the platform, or by being removably inserted into correspondingly-sized holes in the underside of the platform. The legs may also be attached to a swivel member attached to the underside of the platform to permit the platform to swivel about said legs during use.

A foldable back-supporting member may also be used, which may be folded down onto the platform when in storage.

The platform, when folded, is of a size and shape suitable for storage and/or transportation in a pocket, fanny pack, backpack, glove box, etc.

BRIEF DESCRIPTION OF THE DRAWINGS

FIG. 3 is a bottom view of the platform upon being folded.

FIG. 4 is a top view of the platform upon being folded.

FIG. 5 is a side view of the platform upon being folded.

DETAILED DESCRIPTION OF THE PRESENT INVENTION

The present invention will be described in conjunction with FIGS. 1-27 as discussed in detail below.

Figure 2:
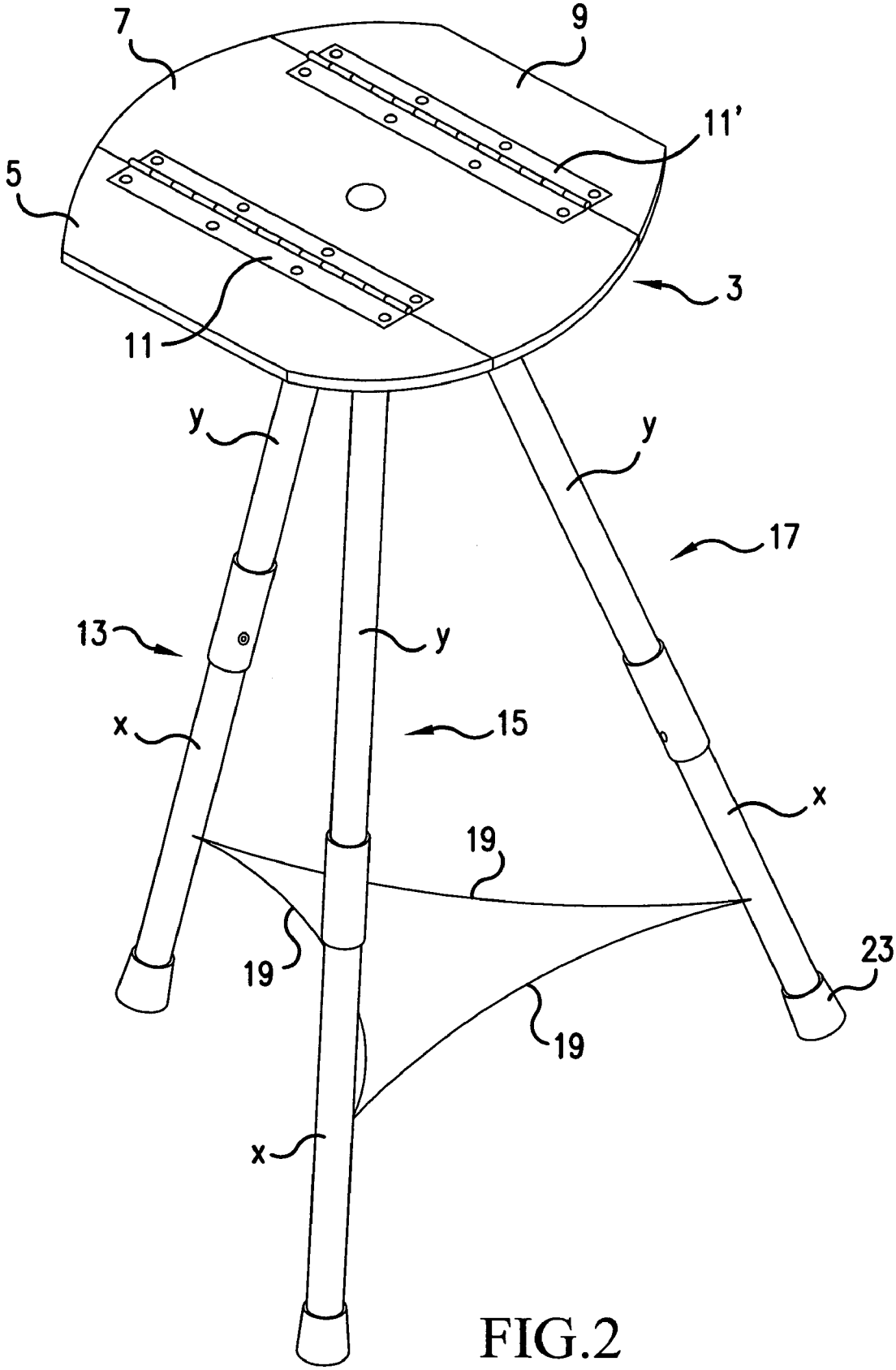
Figure 3:
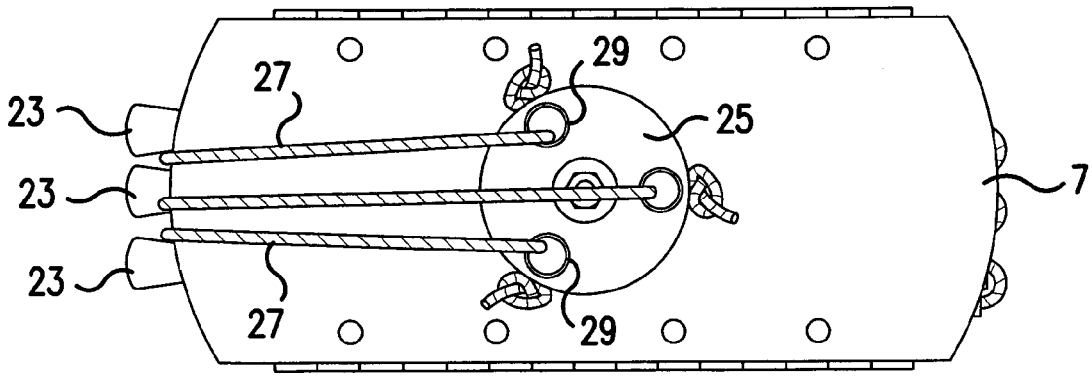
FIGS. 3-5 are views of the portable platform of the present invention when folded for storage or transportation.
Figure 4:
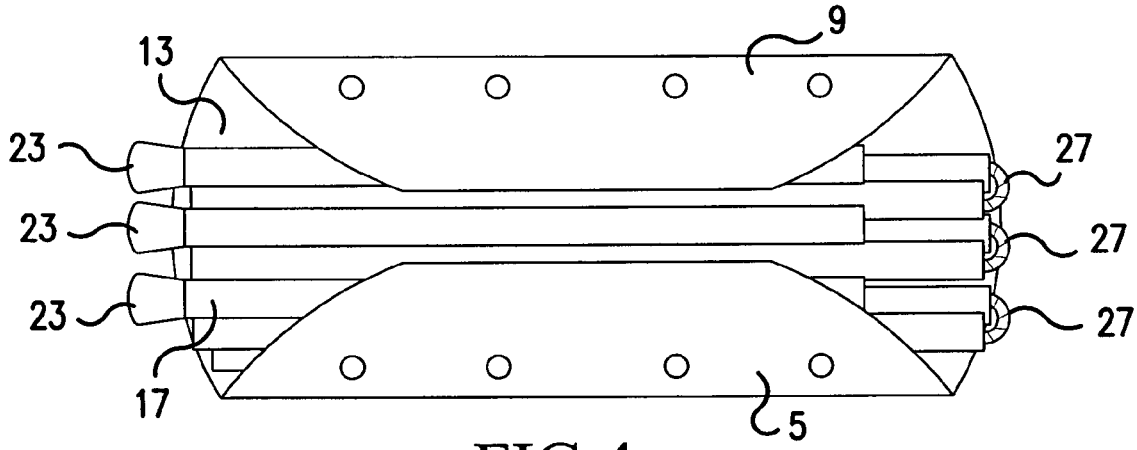
Figure 5:
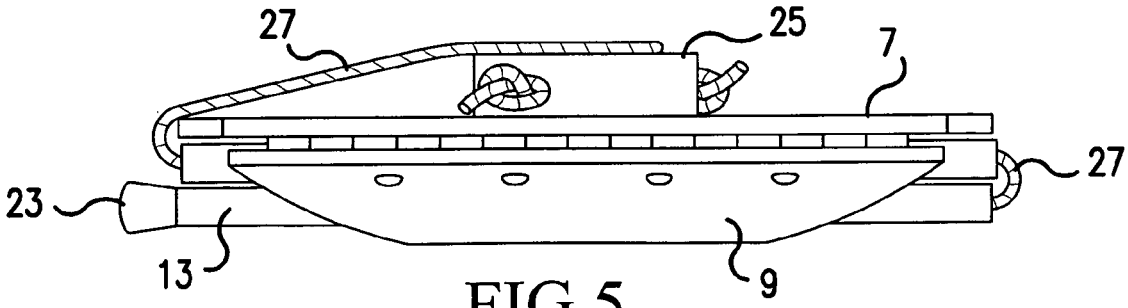
Figure 6:
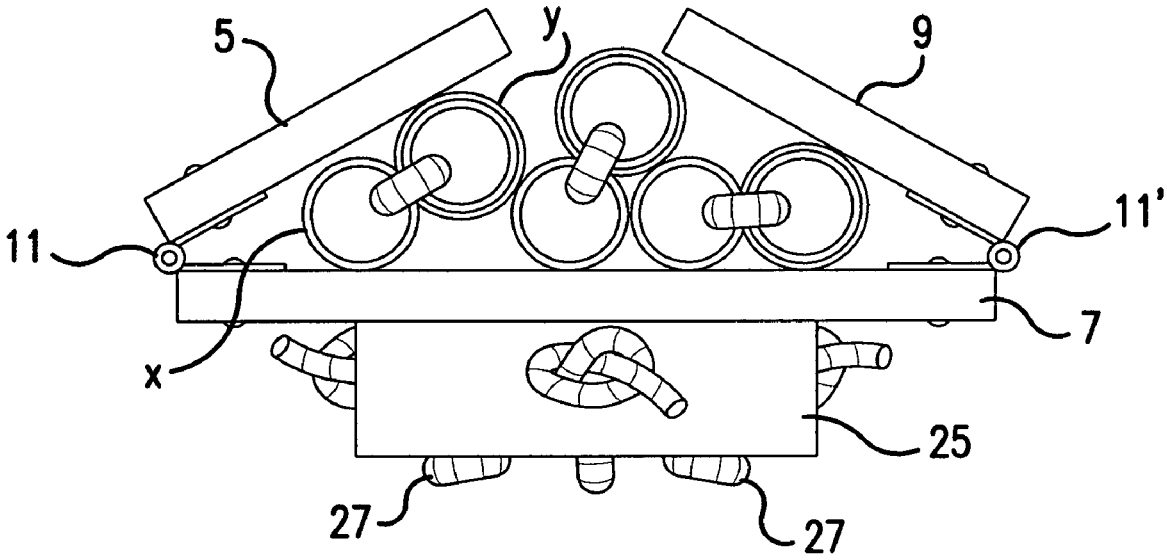
FIG. 6 is an end view of the platform upon being folded.

The portable foldable platform 1 in one embodiment as shown in FIGS. 1-10 comprises a horizontally-disposed platform 3 having foldable sections 5, 7, and 9. Hinge means 11, 11' connect the foldable hinged sections 5, 7, 9 to permit the outermost sections 5, 9 to fold upward and inwardly toward middle section 7 (FIG. 4).

Figure 1:
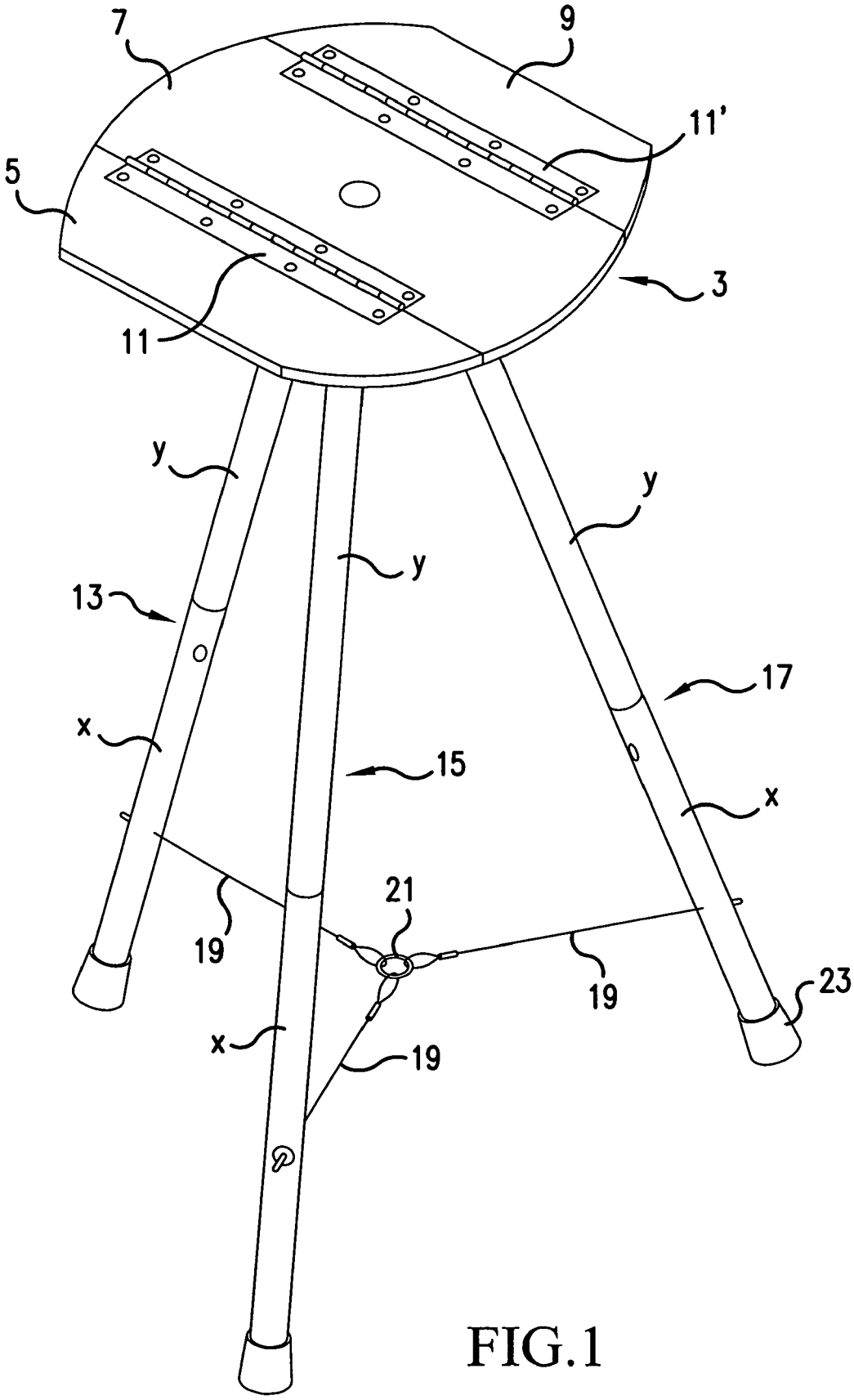
FIGS. 1 and 2 are views of two embodiments of the portable platform of the present invention upon being assembled for use.
Figure 16:
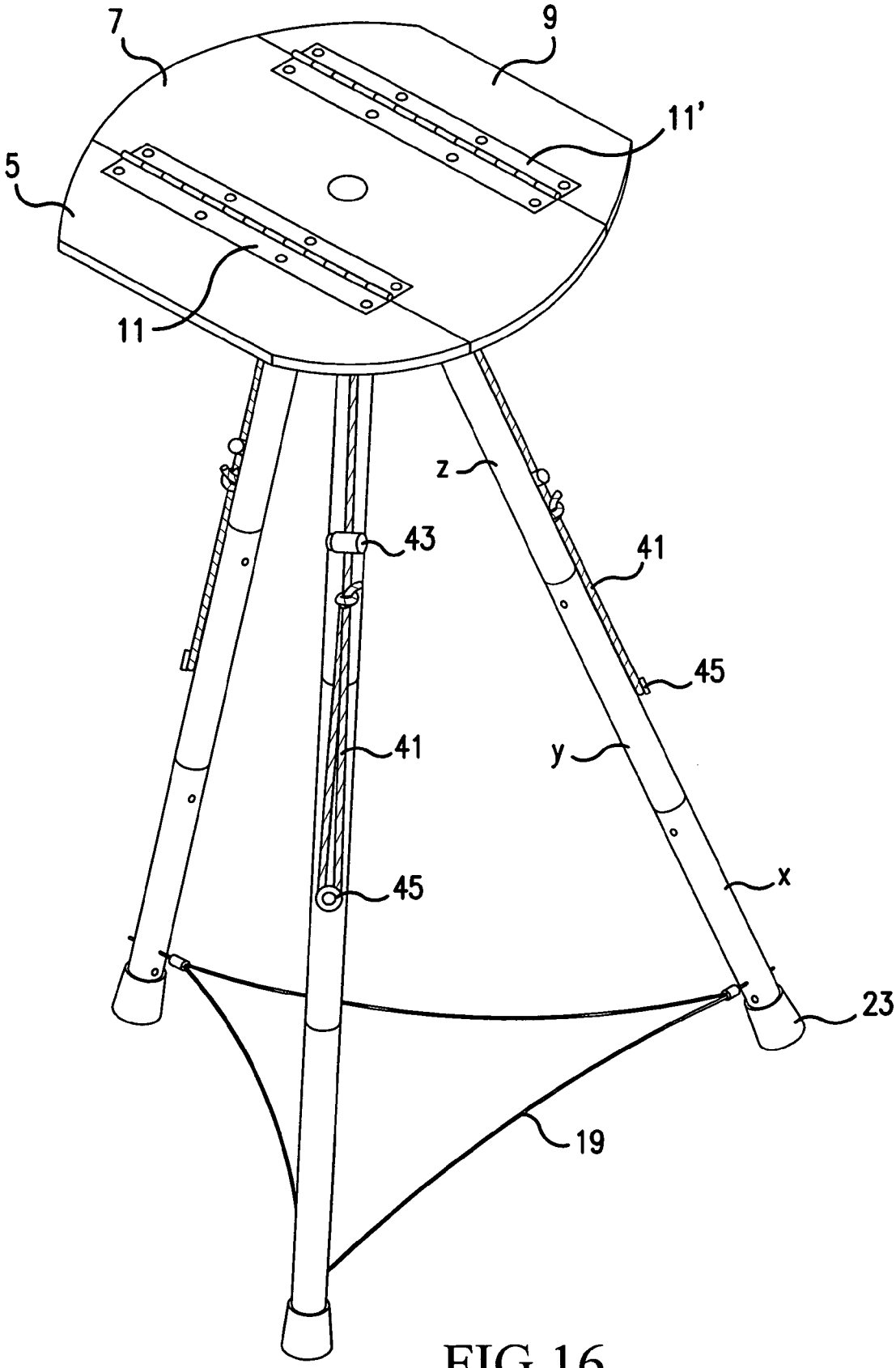
Figure 17:
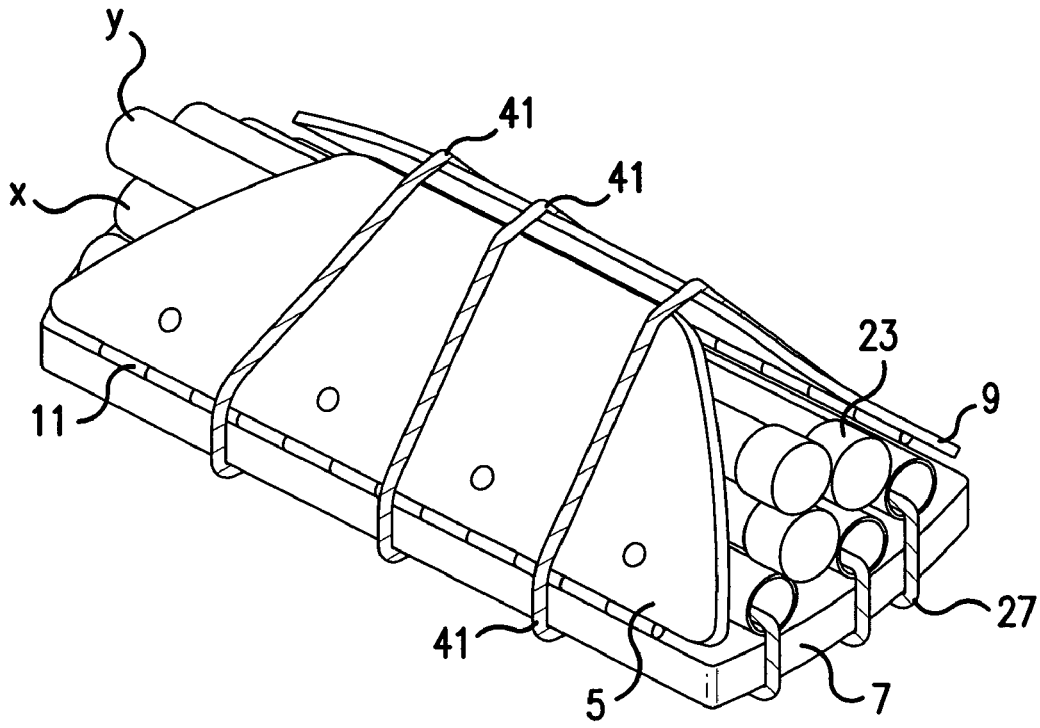
FIG. 17 is a top view of the platform upon being folded.
Figure 18:
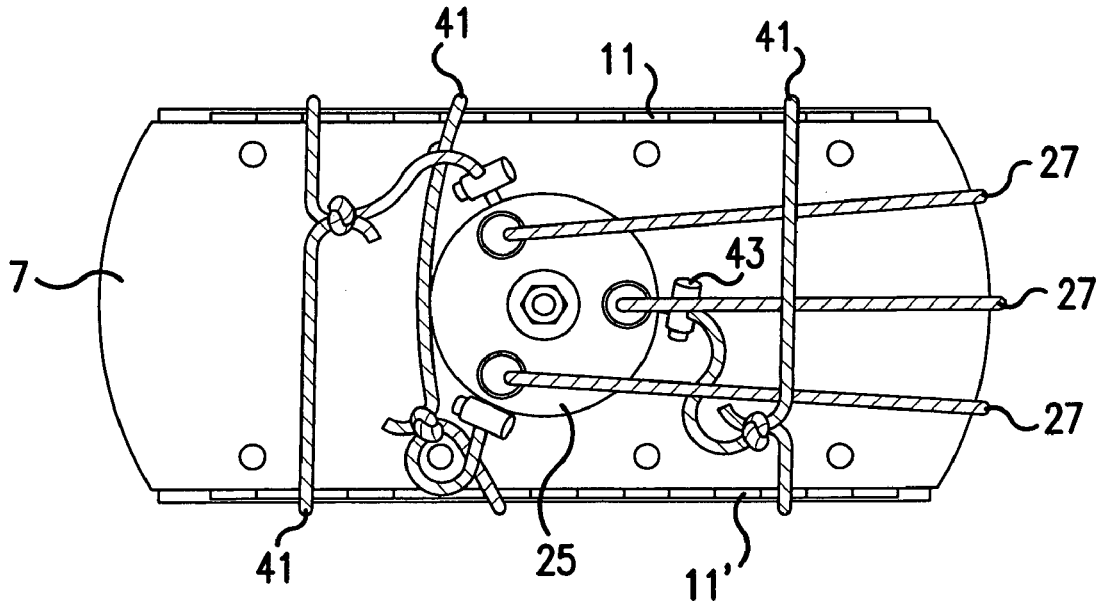
FIG. 18 is a bottom view of the platform upon being folded.

Legs 13, 15, 17 extend from the bottom of the platform 3. The legs as depicted in FIGS. 1 and 2 are comprised of nestable sections x, y which, when assembled or nested together, support the foldable platform 3 a distance from the ground substantially corresponding to the length of the assembled legs. While three legs are depicted, and the use of three legs is preferable, it is also possible for the platform to be supported by more than three legs such as, for example, four legs. While two leg sections x, y are depicted in the drawings (FIGS. 1, 2, 15, 22, 23), more than two sections may be employed as desired. For example, three or more nestable or connectable leg sections may be employed (FIG. 16).

The legs 13, 15, 17 are preferably stabilized by cables/wires 19 which may be interconnected at a common connection 21. The connecting cables/wires prevent the assembled legs from extending laterally outwardly to an extent such that the legs no longer provide adequate structural support for the platform 3. The cables/wires 19 are preferably connected to each lowermost leg section to maximize the ability to provide stability to the platform. In FIG. 1, cables/wires 19 connect to a common center point 21. In FIG. 2, cables/wires 19 connect and extend laterally between, adjacent leg portions, as opposed to being connected at a common center point 21.

Figure 20:
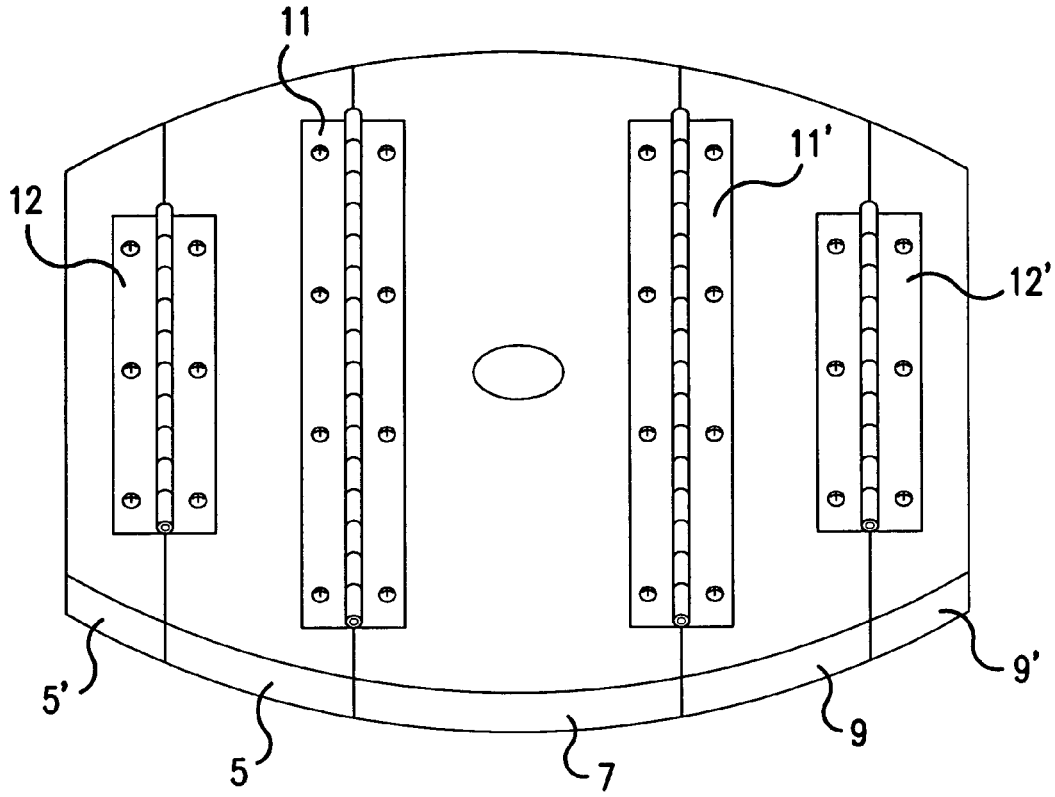
FIG. 20 is a view in perspective of another embodiment of the foldable platform of the present invention.
Figure 21:
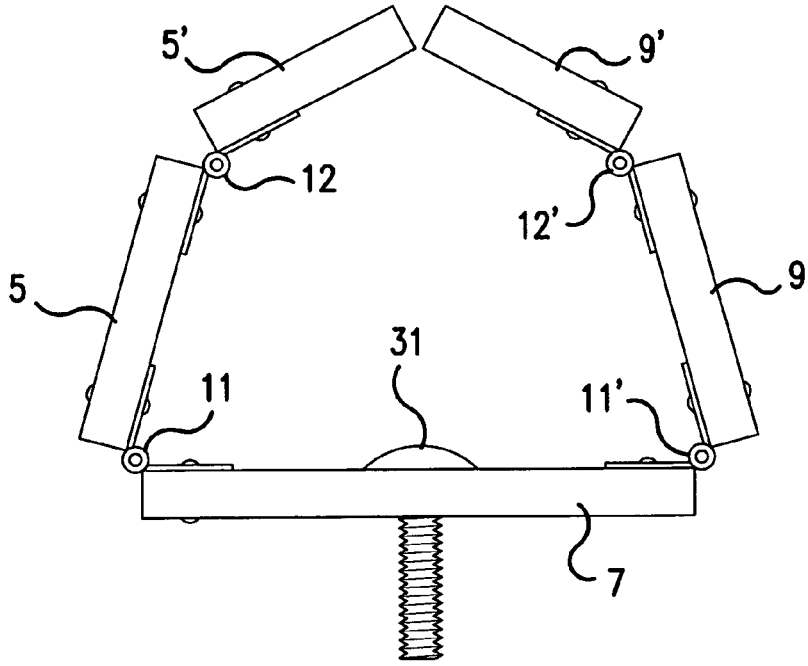
FIG. 21 is a side view of the platform of FIG. 20 upon having the platform sections folded in storage mode.
Figure 22:
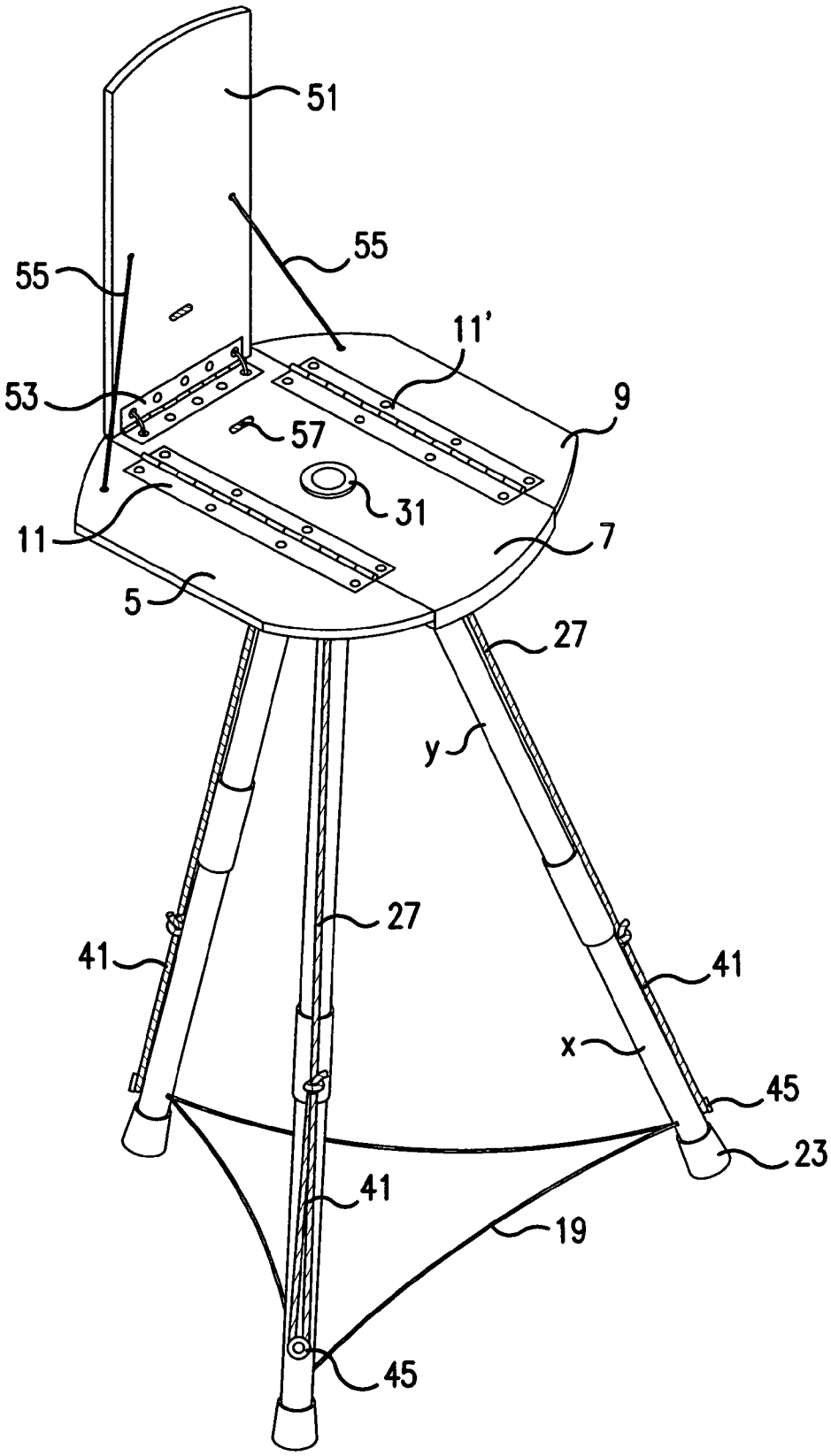
FIG. 22 is a view of the platform of the present invention having a back-supporting member extended for use.
Figure 23:
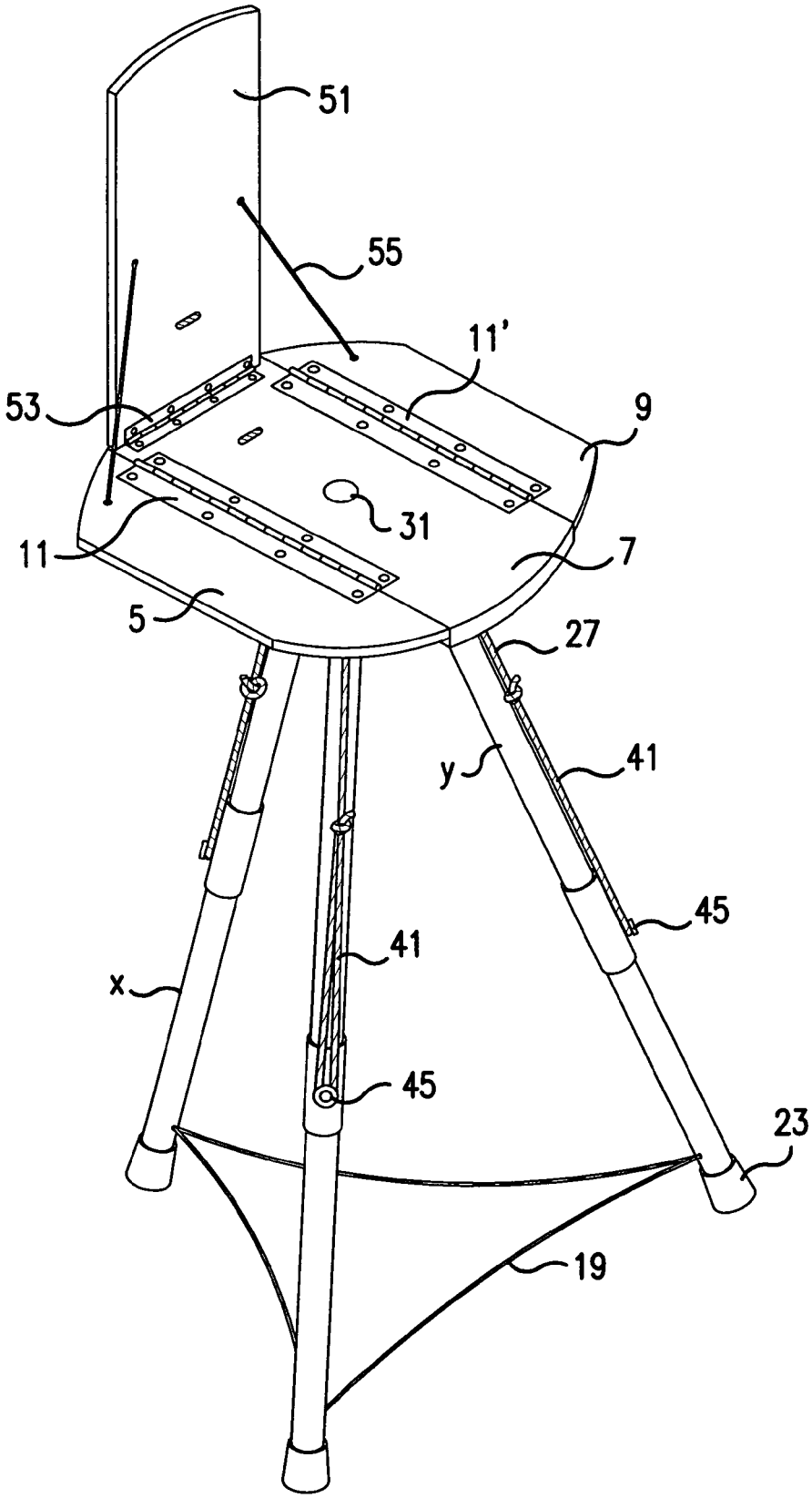
FIG. 23 is an alternative embodiment of the platform of the present invention having a back-supporting member extended for use.
Figure 24:
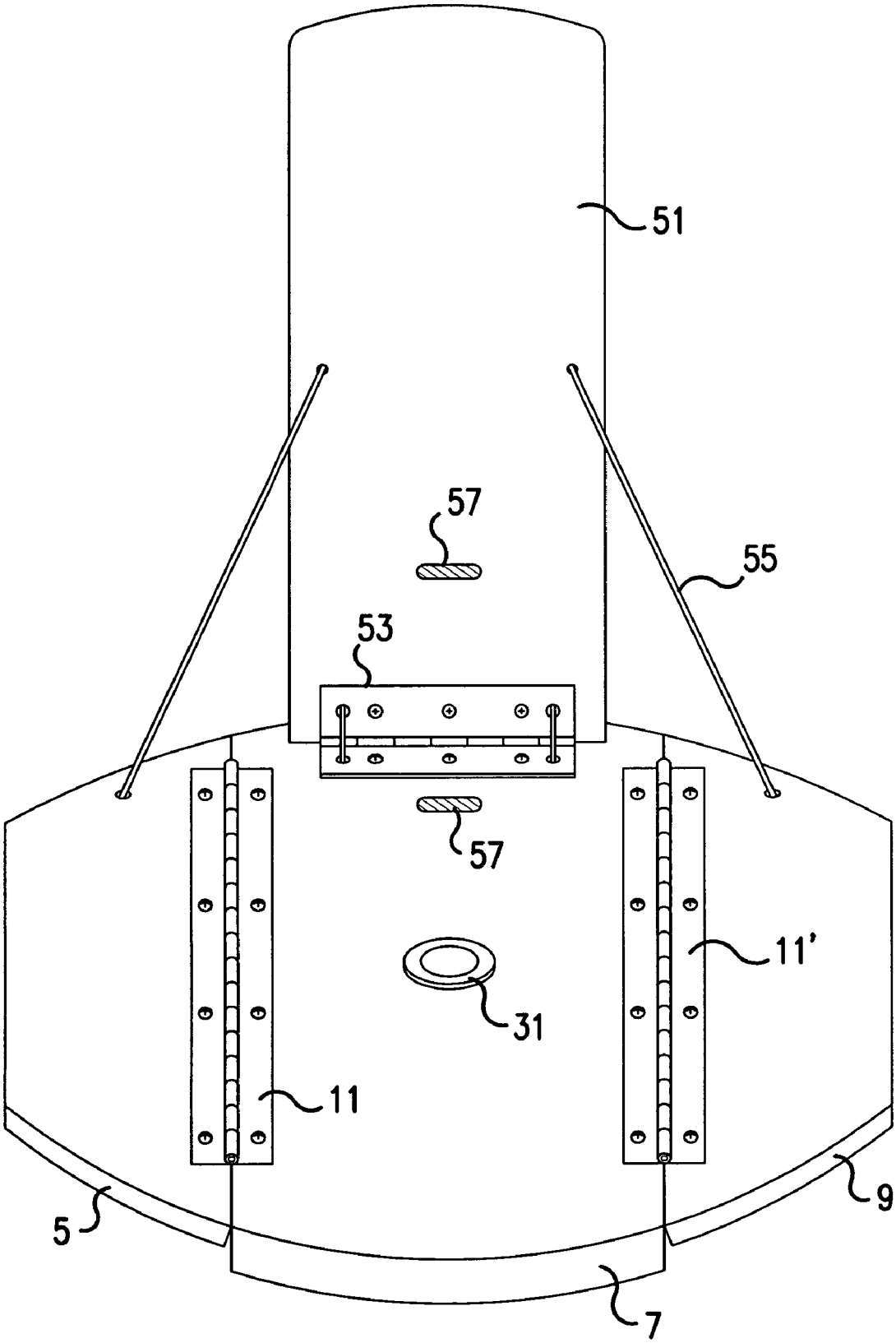
FIG. 24 is a top view of the seat portion of the platform of FIG. 22.
Figure 25:
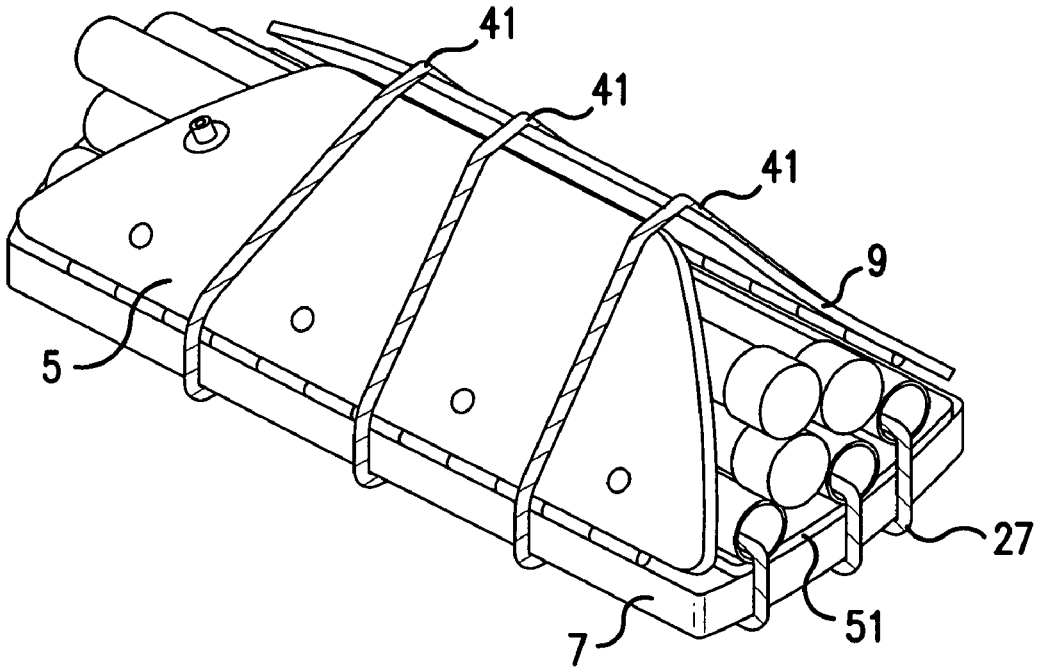
FIG. 25 is a top view of the platform of FIG. 22 when folded for storage.
Figure 26:
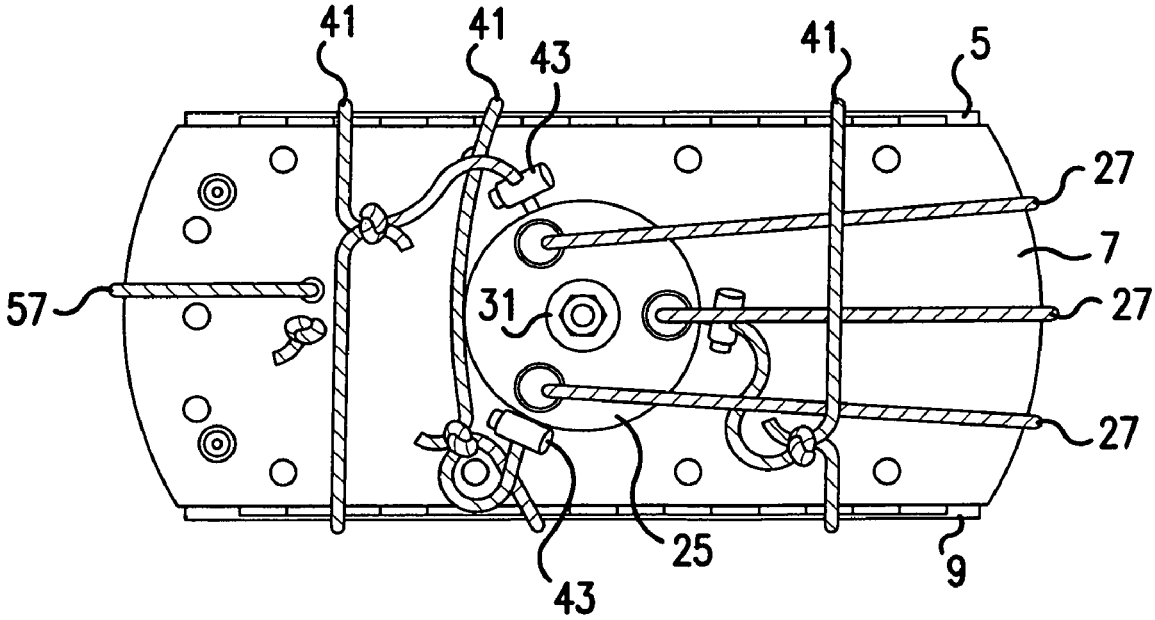
FIG. 26 is a bottom view of the platform of FIG. 22 when folded for storage.

The portable foldable platform 1 comprises a horizontally-disposed platform 3 having foldable sections 5, 7, and 9 (FIGS. 1 and 2), or platform 3' having foldable sections 5, 5', 7, 9, 9' (FIG. 20). Hinge means 11, 11' (FIG. 1 or 2) connect the foldable hinged sections 5, 7, 9 to permit the outermost sections 5, 9 to fold upward and inwardly toward middle section 7. Hinge means 11, 11', 12, 12' (FIG. 20) connect the foldable hinged sections 5, 5', 7, 9, 9' to permit the outermost sections to fold upward and inwardly toward middle section 7. FIG. 21 shows an end view of the platform sections 5, 5', 7, 9, 9' of FIG. 20 when folded in storage position.

Legs 13, 15, 17 extend from the bottom of the platform 3. The legs are comprised of multiple nestable sections x, y (FIGS. 1 and 2), x, y, z (FIG. 16) which, when assembled or nested together, support the foldable platform a distance from the ground substantially corresponding to the length of the assembled legs.

The respective leg sections may be fastened together by any suitable means. For example, opposing ends of the legs may be configured to nest within one another, whereby the end of one leg has a lesser diameter than the opposing end of an adjacent leg. The legs may either be friction fit together, or other attachment means such as matching holes and buttons may be used to ensure a good fit. A cam-like attachment sleeve means may also be employed whereby a sleeve on one leg section fits over the end of an adjacent leg section, with an interlocking fit being obtained upon twisting of the sleeve about the adjacent leg section to engage a pin or protrusion within a groove in the sleeve.

Inner and outer sleeves may also be employed to provide nestable or connectable leg sections. Inner sleeves may be provided which are configured to fit within the bores of adjacent leg sections, with an intermediate shoulder on the inner sleeve serving as a spacer between the opposing ends of the leg sections. See FIGS. 7 and 7A in this regard.

Figure 19A:
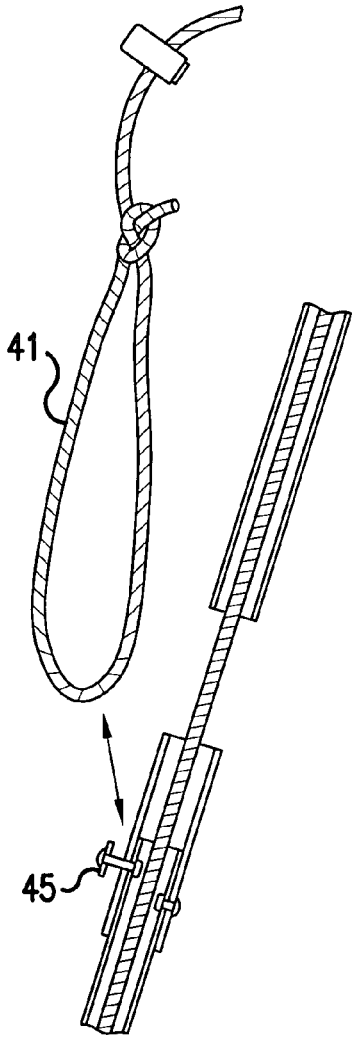
FIG. 19A is an exploded view of a portion of FIG. 19.
Figure 19:
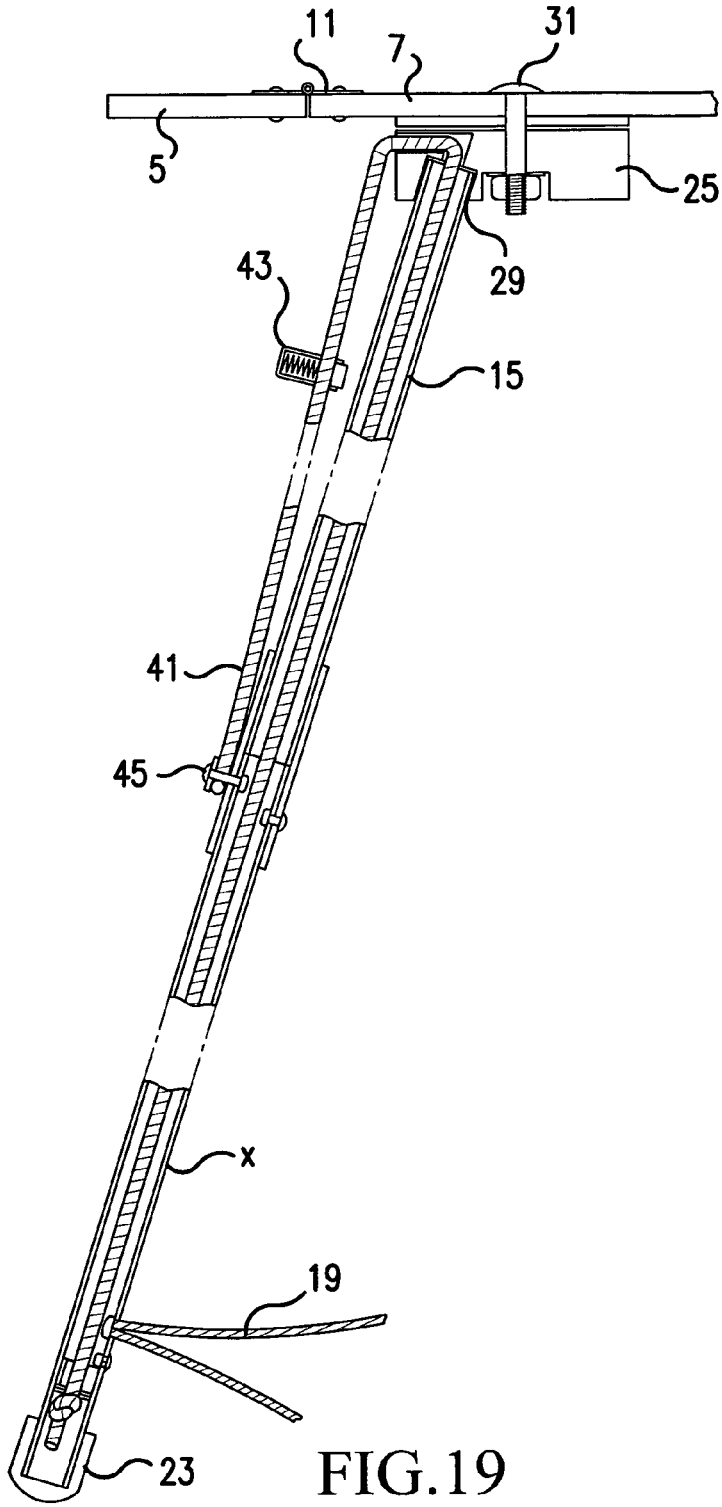
FIG. 19 is a cross-sectional view of one embodiment of the joint between two adjacent leg sections.

It has been found to be preferable, to assist in maintaining the nestable legs in assembled form, to provide elastic cables/cords 27 within the interior of the leg members whereby tension may be maintained between opposing ends of the nested leg portions. One end of the elastic cable/cord may be connected to the lowermost leg sections x, and the other end of the elastic cable/cords may be connected to the middle section 7 of the platform 3 after extending through adjacent leg section y (FIGS. 7, 8, 19).

It has been found preferable for the cable/cord to be attached to an interior portion of the bottom-most leg section x at a point near the bottom end of the leg section such as by attachment to a rivet, etc., within the leg. See FIGS. 7, 8, and 19 in this regard. Attachment at that point maximizes the length of the elastic cable/cord that may be stretched upon the legs being disassembled.

The elastic cable/cord is dimensioned lengthwise such that the respective leg sections, when nested, are maintained in a tensioned or biased relationship with respect to each other—i.e., upon assembly, the respective leg sections are maintained in a biased relationship toward the bottom of the platform 3 specifically the bottom of platform section 7. A thickness of from 1/8 to 3/16 inch has been found useful for the elastic cable/cord.

The bottom ends of the legs 13, 15, 17 preferably include end caps 23 which serve to seal the ends of the leg members. In order to assist in preventing the ends of the legs from sinking into a soft surface, the end caps may be flared outwardly to provide enhanced surface contact by the ends of the legs.

In order to provide a platform which swivels, the uppermost ends of legs 13, 15, 17 may be attached to a swivel member 25 (FIGS. 7, 8 and 19) attached to the bottom of platform section 7 by suitable means such as a nut/bolt assembly 31. When assembled, the platform 3 may thus swivel about the supporting legs to permit ease of use of the platform.

When a swivel is present, the uppermost end of the elastic cable/cord is attached to swivel member 25. In a preferred embodiment, the elastic cable/cord enters a hole or channel 39 in the swivel, with the cable/cord being tied off or fixed to the swivel in a manner which will maintain the cable/cord under tension when in use (FIGS. 7 and 8). In this manner, the legs may be attached to the bottom of the swivel without impeding the ability of the swivel to rotate about the bottom of the platform 3.

In an alternative embodiment as shown in FIGS. 13-16, 19, 22-23 and 27, the elastic cable/cord 27 laterally exits a hole or channel 39 in the side of the swivel member or fixed member 49, with the cable/cord 27 being tied off in a loop 41 which permits the cable/cord 27 to be removably attached to connector 45 on the exterior of a leg section (which may be, for example, a pin or hook capable of engaging the end of loop 41) extending from the outer surface of the leg connector. Barrel lock 43 and loop 41 may be used to adjust the tension of the cable/cord extending from the swivel, both for the cable/cord 27 which extends either through the interior of the legs, or which extends along the exterior of the leg. This, in effect, enables double tensioning of the legs to increase the stability of the leg/swivel connection, as well as the stability of the connection of the respective leg sections.

In the event a swivel member is present, the legs may be attached to the bottom of the swivel member without impeding the ability of the swivel to rotate about the bottom of the platform 3.

The swivel member may be comprised of any suitable material having sufficient dimensional stability, such as an engineering plastic such as a polycarbonate, metal or wood, etc.

The top end of the legs may be attached to the bottom of the platform in any suitable manner. For instance, the legs may be removably seated upon downwardly-extending posts 47 (FIGS. 12-14) attached to the bottom of the platform which are sized to snugly fit inside each hollow leg to maintain each leg in the desired position. Each post 47 is angled outwardly so that the distance between the legs would increase as shown in FIG. 1, for example. The posts can be inclined approximately 15-20° to the vertical axis with advantage. The posts may be attached to either the bottom of platform section 7 by fixed member 49 (in which case a swivel means would not be employed), or to the bottom of the swivel member 25 (if it is desired to have a swivel function).

Alternatively, the top ends of the legs may be seated in correspondingly sized holes 29 (FIGS. 7, 8, 11, 19) in the bottom of, for example, a swivel 25. The swivel is suitably attached to the platform by a combination bolt/nut assembly 31. In order to assist in orienting the legs toward the ground, the holes are angled outwardly so that the legs, when seated in the holes, are outwardly angled so that the distance between the legs increases as the legs extend toward the ground as shown in FIGS. 1 and 2. It has been found that holes approximately 0.5 inch deep and inclined approximately 20° to the vertical axis are suitable. An angle of inclination ranging from 15-20° will generally suffice. The degree of inclination may vary and is, for example, dependent upon the end use of the platform. For instance, when used as a seat, it is preferable for the angle of inclination to be relatively small to increase the ability of the legs to support a load.

A platform height of from 15-20 inches has been found to be suitable for the platform to serve as a seat. Of course, the ultimate height depends upon the number of leg sections employed. It has been found that leg sections of approximately 7-10 inches in length are satisfactory, and assist in providing a compact folded platform.

Further, it is possible to provide extensible portions for at least one leg section in each leg so that the length of each leg may be modified without adding additional leg sections. For example, a sleeve section to which the bottom of the leg is attached may be slideably engaged with the next adjacent section with pin or button/hole engaging means to maintain the respective portions in fixed relationship at the desired axial position. In the embodiment where three legs are employed, it is only necessary to provide a single leg which is extensible in order to provide adequate leveling on non-level ground.

FIGS. 7, 7A, 8 and 8A depict various embodiments depicting how the nestable leg sections may be connected to one another.

Figure 7A:
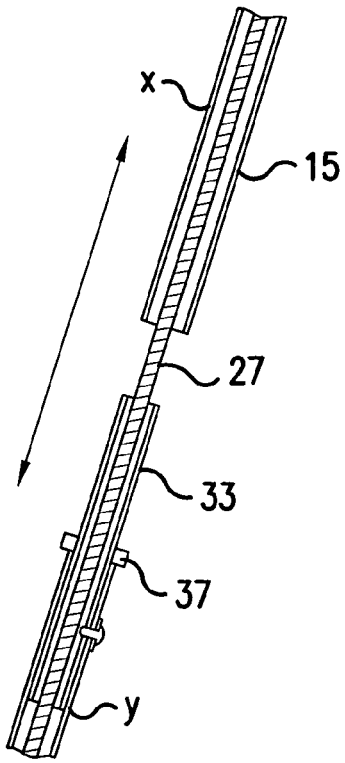
FIG. 7A is an exploded view of a portion of FIG. 7.
Figure 7:
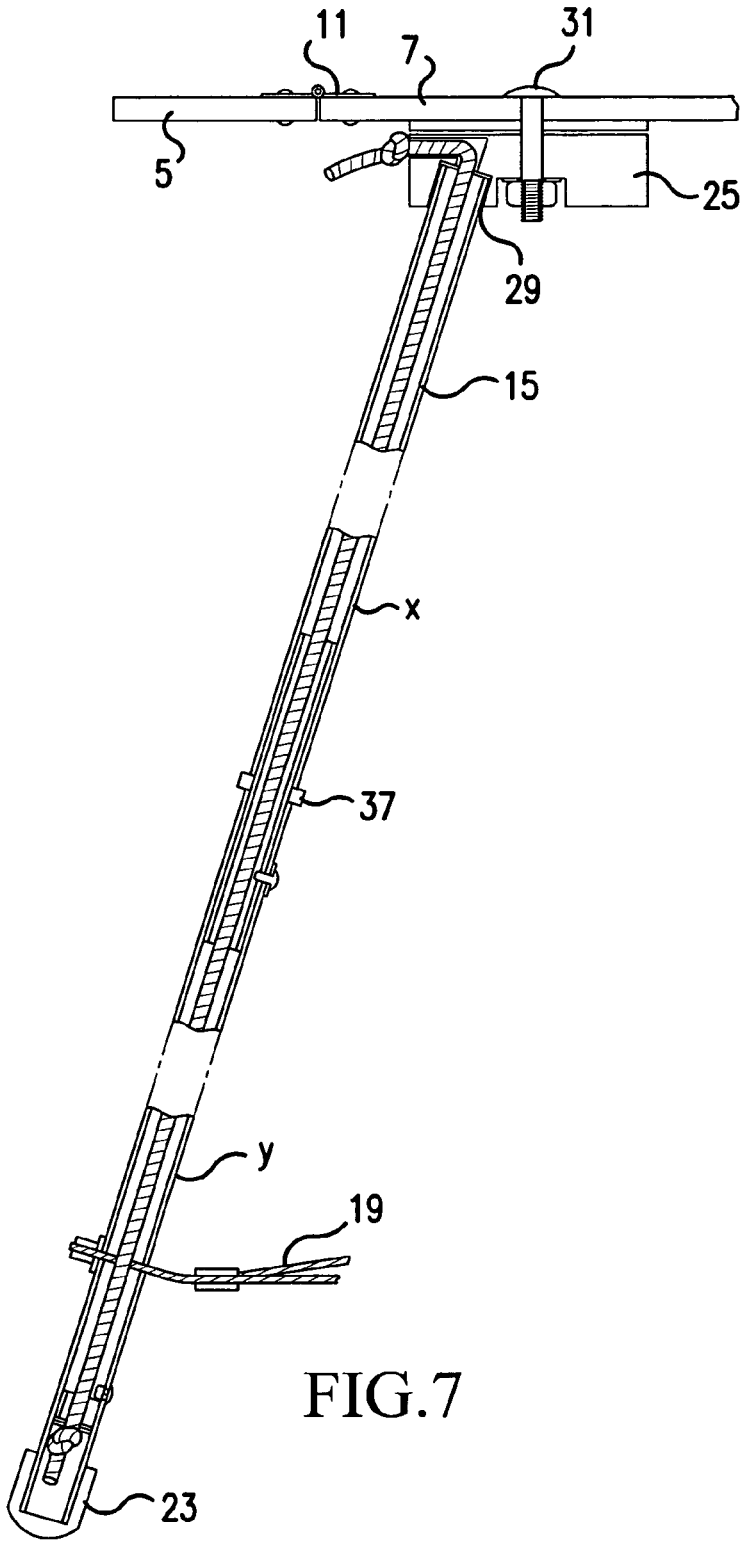
FIG. 7 is a cross-sectional view of one embodiment of the joint between two adjacent leg sections.

FIGS. 7, 7A depict an embodiment where leg sections x, y of leg 15 have an internal sleeve 33 having opposing ends which fit within opposing ends of leg sections x, y. Shoulder section 37 abuts the respective opposing ends of leg sections x, y to provide an abutment there-between and cushioning the leg sections from each other. FIG. 7 also depicts swivel member 25 having holes 29 into which an end of leg 15 is inserted. FIG. 7 also depicts an end of elastic cable/cord 27 extending from an open end of leg 15 through hole 39 of the swivel member 25 to be secured thereto by suitable means such as a knot. The elastic cable/cord 27 may also be secured at the opposing end of leg 15 within the interior thereof by suitable means such as by a knotted portion. Swivel member 25 is attached to platform section 7 by suitable means such as a nut and bolt assembly 31. This permits the platform portion to swivel about the legs upon use if so desired.

Figure 8A:
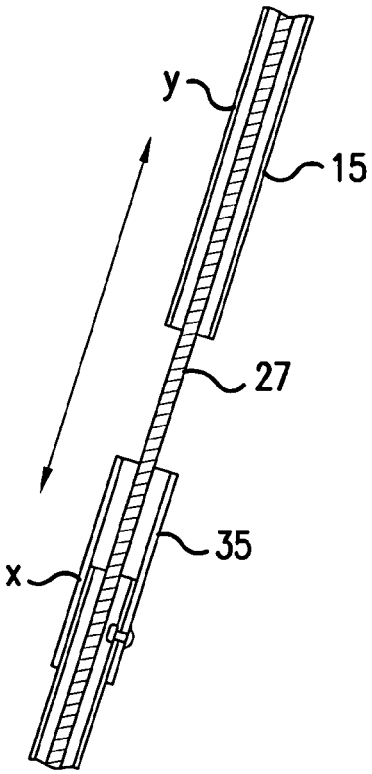
FIG. 8A is an exploded view of a portion of FIG. 8.
Figure 8:
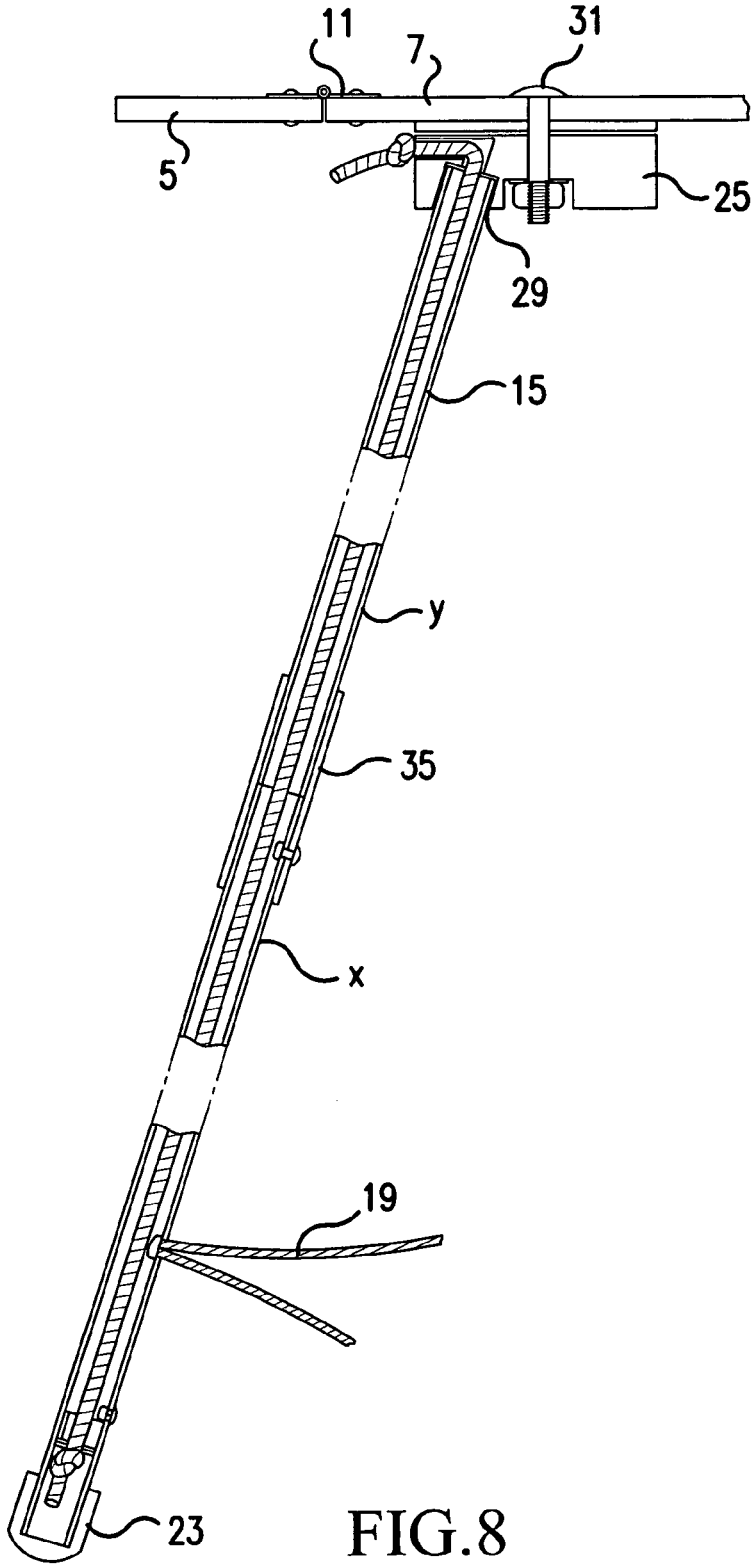
FIG. 8 is a cross-sectional view of another embodiment of the joint between two adjacent leg sections.
Figure 9:
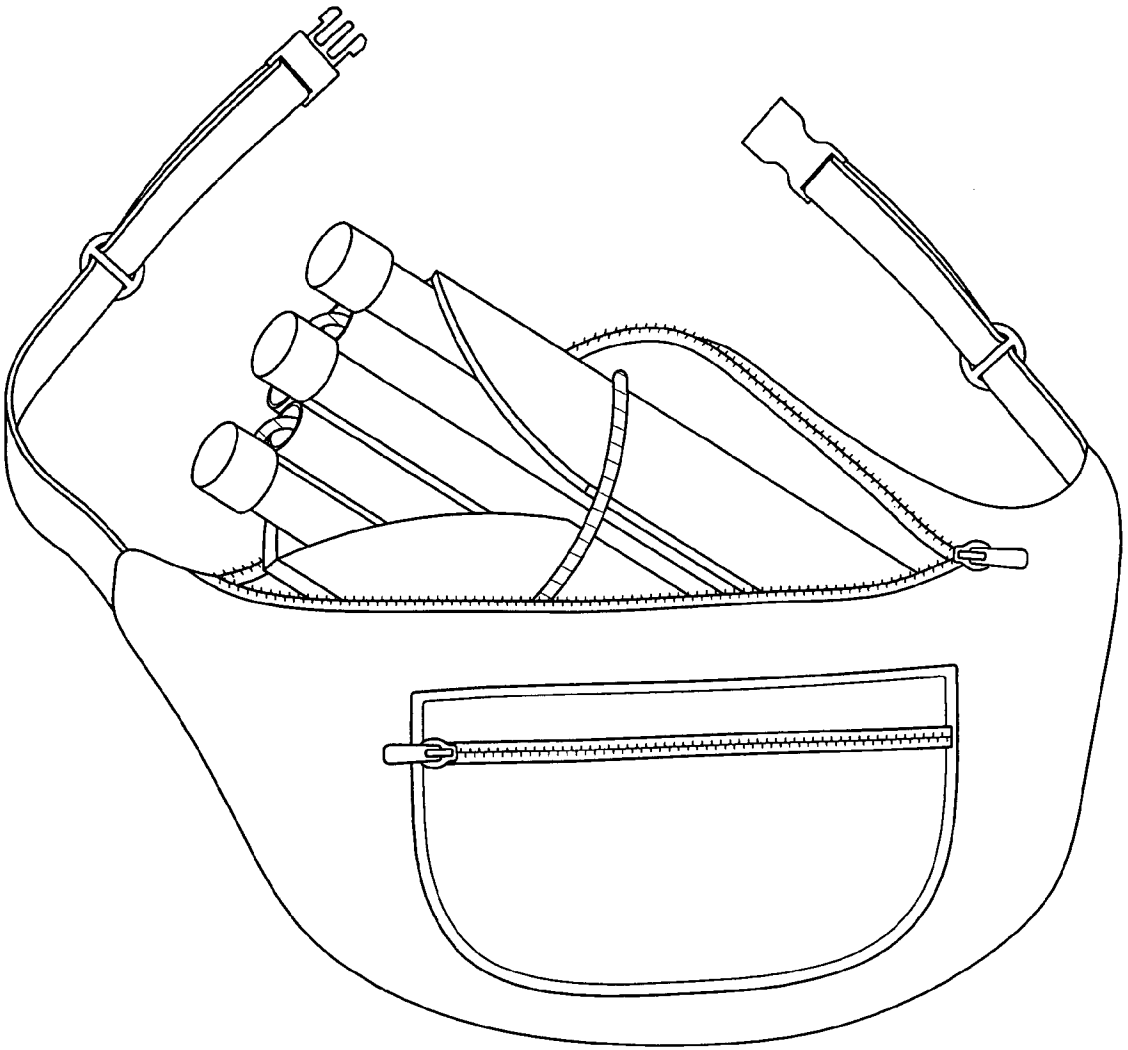
FIG. 9 is a view in perspective of the folded platform of the present invention being stored in a fanny pack.
Figure 10:
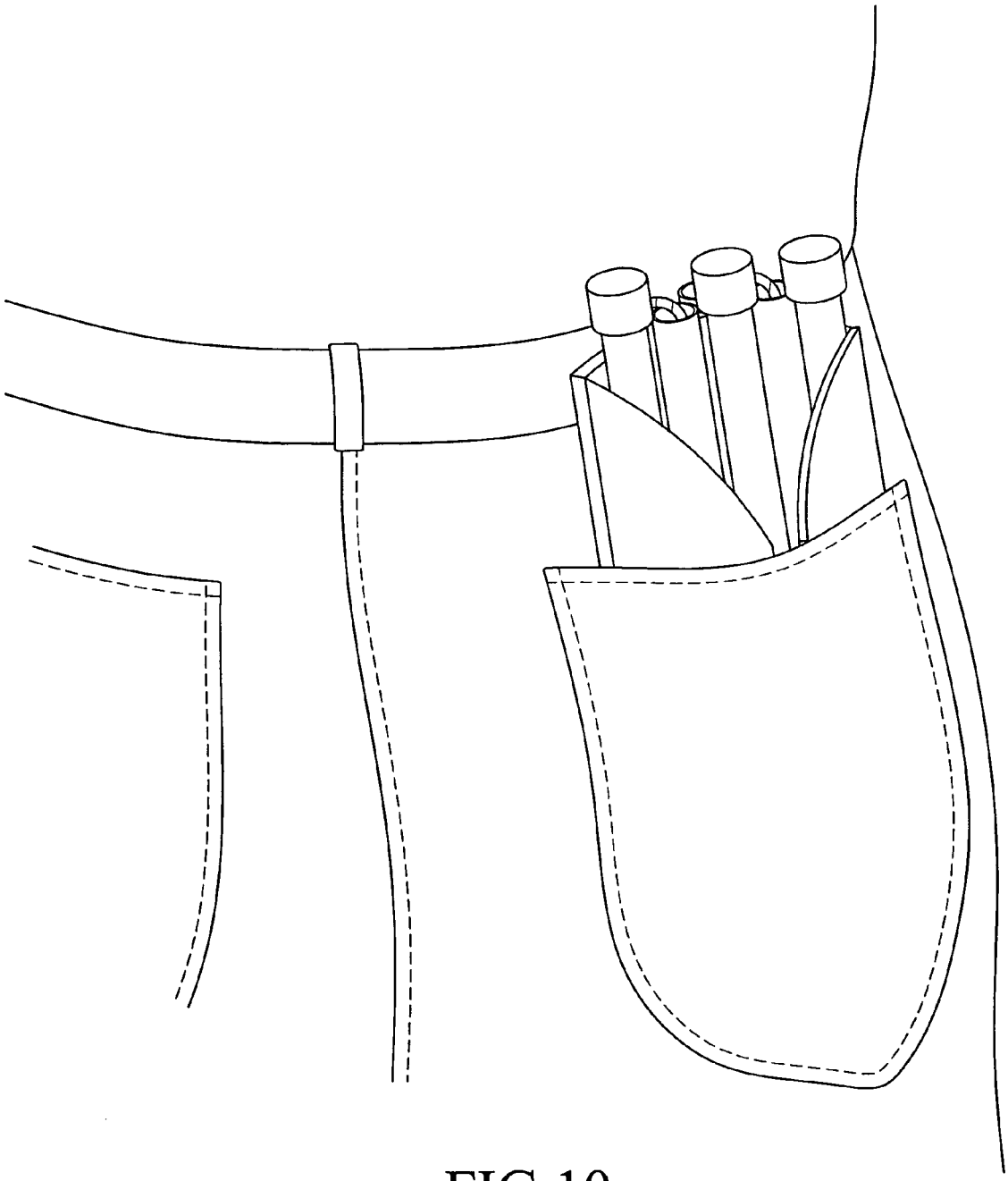
FIG. 10 is a view in perspective of the folded platform of the present invention being stored in a pant pocket.
Figure 11:
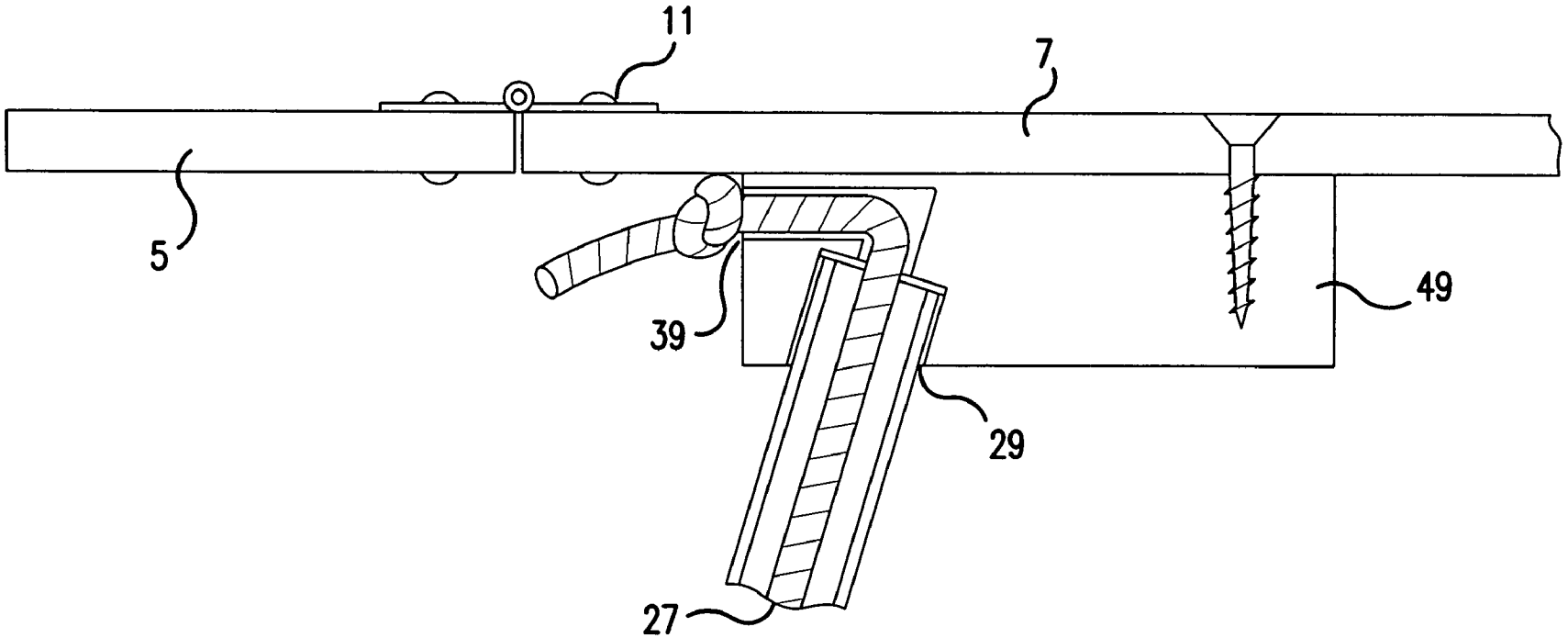
FIG. 11 is a cross-sectional view showing the legs inserted into a non-swivel fitting.
Figure 12:
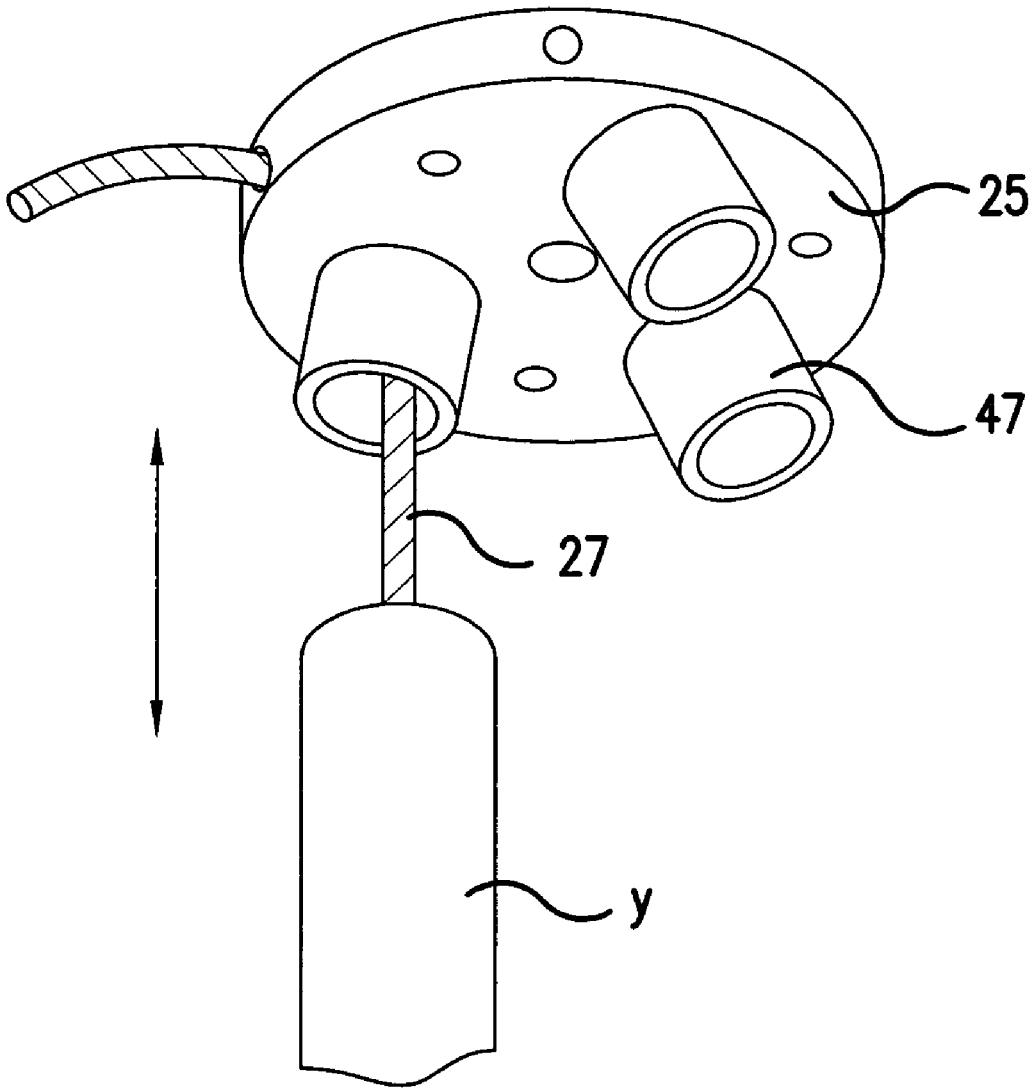
FIG. 12 is a view in perspective of an embodiment of the swivel member having supporting posts for insertion into an end of the legs.
Figure 13:
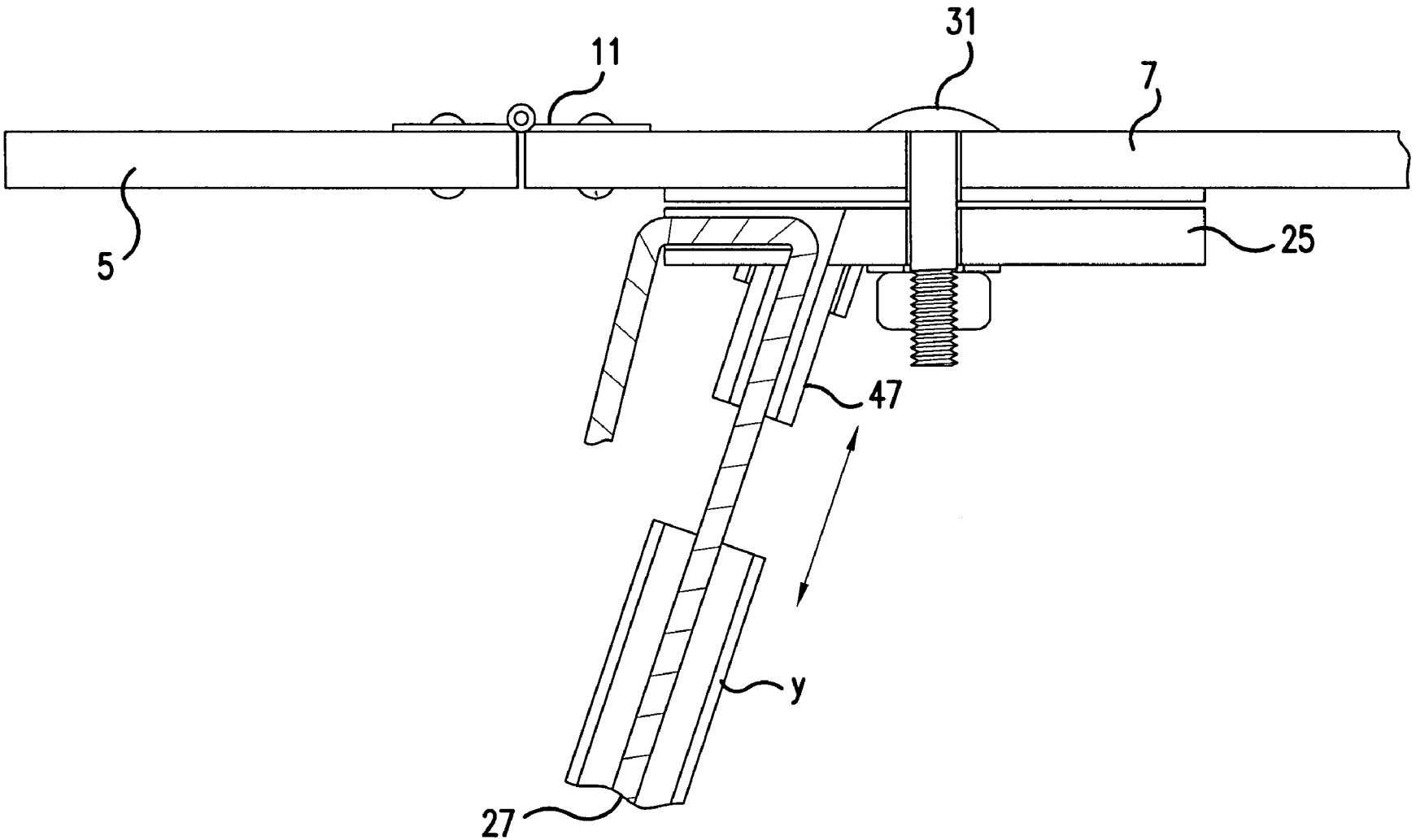
FIG. 13 is a cross-sectional view of the embodiment of FIG. 12 depicting the use of posts to support the ends of the legs from a swivel.
Figure 14:
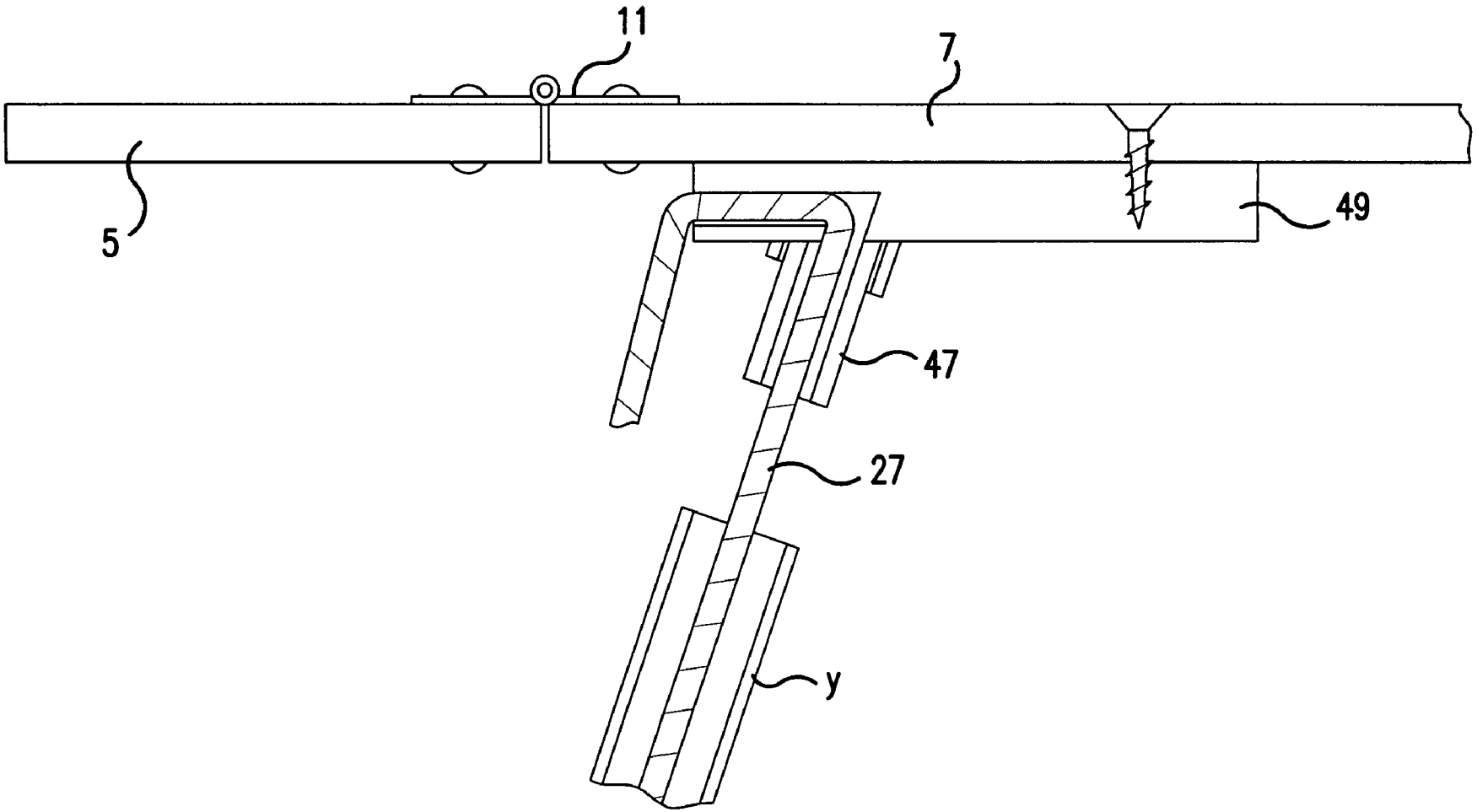
FIG. 14 is a cross-sectional view showing the use of posts to support the ends of the legs from a non-swivel member.
Figure 15:
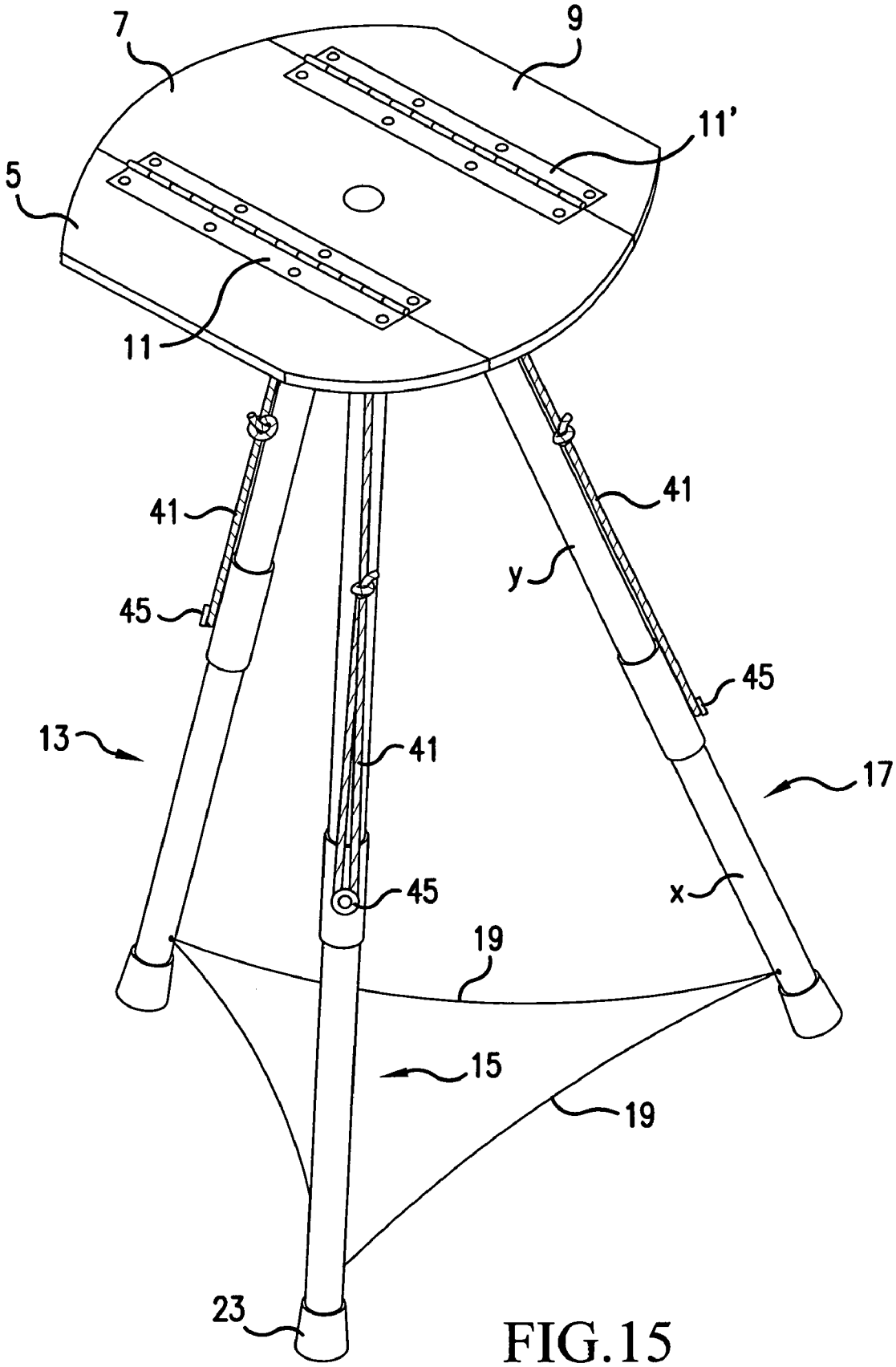
FIGS. 15 and 16 are views of two embodiments of the portable platform of the present invention upon being assembled for use.

FIGS. 8, 8A depict an alternative embodiment to FIGS. 7, 7A. The embodiment of FIGS. 8, 8A differs from that of FIGS. 7, 7A in that an external sleeve 35 is employed instead of an internal sleeve 33 as in FIGS. 7, 7A. The external sleeve is attached at one end thereof to an end of one section of leg 15. As depicted, an end of sleeve 35 is attached to an end of leg section x, such that leg 15 is assembled by insertion of a bottom end of leg portion y into the open end of sleeve 35.

In operation, the platform of FIG. 1 or 2 is folded in the following manner. The legs are removed from engagement with the holes in the bottom of the swivel member. The legs are then caused to be pulled together horizontally such that the top ends of the legs are extended to a point outside of the lateral edge of the platform 3. This will cause the elastic cable/cord to be stretched and placed under tension as shown in FIGS. 3 and 4. The legs are then laid down upon the top of the platform substantially parallel to each other as shown in FIG. 4. The bottom sections of the legs may then be pulled from nesting engagement with the top portion of the legs and folded back upon the top of the platform adjacent the other leg sections as shown in FIG. 4.

Once folded upon the top of the platform 3, the side sections 5, 9 of the platform may be folded up and onto the folded leg portions to assist in maintaining the leg sections in storage position. It is also desirable to use the looped elastic member 41 which may be looped over the folded platform sections to maintain the folded sections in contact with the leg sections while under tension.

Advantageously, in yet another embodiment, the foldable platform may be provided with a back-supporting member 51 as shown in FIGS. 22-27. The back-supporting member 51 is attached to an end of the centrally-positioned platform section 7 by suitable means such as by a hinge 53. When in storage position, the back-supporting member 7 is caused to be placed down upon the centrally-positioned member 51 of the platform. When in use, the back-supporting member 51 is caused to be moved to a substantially upright position, so that it may support the lower back portion of a person using the platform as a seat. In order to enhance the structural integrity of the back-supporting member during use, support wires 55 may be provided at each side of the back-supporting member. The wires 55 connect to both a side of the back-supporting member, as well as to one of the side-most sections 5, 9 of the platform.

Figure 27:
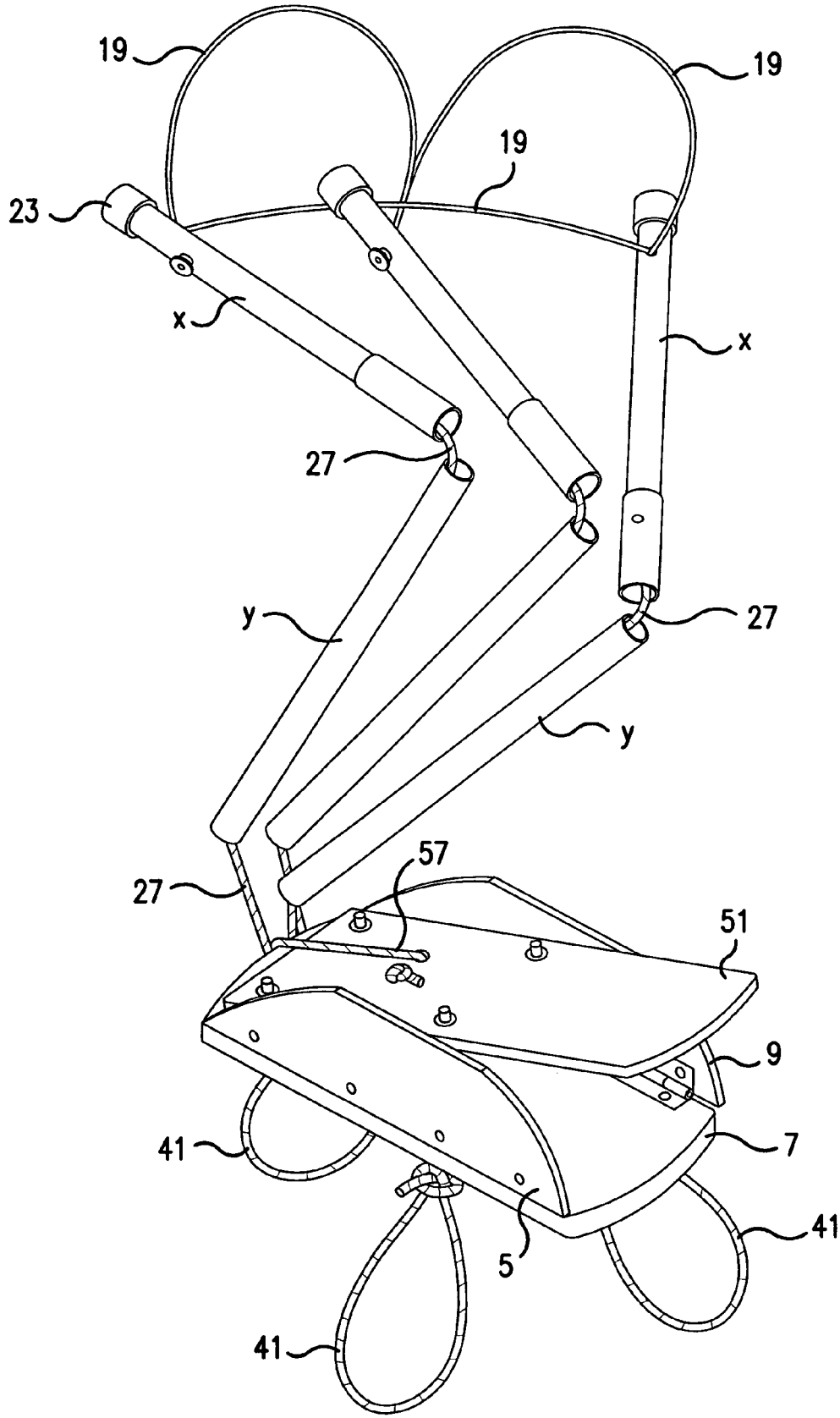
FIG. 27 is a view of the platform of FIG. 25 being unfolded for use.

Advantageously, during use, the back-supporting member, when flexed rearwardly, places tension on the support wires 55, which in turn causes the anchoring platform sections 5, 9 to move upwardly against the seated portion of the person. This combined effect enhances the comfort of the person seated on the seat. FIG. 27 depicts the platform of FIG. 22 as it is being changed from its storage position of FIG. 25 to the assembled position of FIG. 22. Further, in order to assist the back-supporting member to remain in an upright position, elastic cords or springs 57 may be attached to the back-supporting member at one end, and to the underside of the platform at the other end. Alternatively, a spring hinge may be used. This will assist the back-supporting member to be inclined upwardly upon assembly of the platform.

The platform sections and back-supporting member may be comprised of any suitable material having the desired dimensional stability which can serve as a seat, table, chair back, etc. The use of plywood as a platform material has been found to be suitable, although the platform sections may be comprised of a metal such as aluminum, fiberglass or carbon fiber or similar composite material, plastic, etc. No limitation exists regarding the type of material employed except that the material should be sufficiently load bearing and not so heavy as to reduce the portability of the platform. A cover (such as a fabric cover) may also be provided to enhance the appearance of the platform and back-supporting member. It is also desirable to place a padding material (such as a foamed material) between the fabric and the top surface of the platform to cushion the seat.

The legs are comprised of any material which provides acceptable supporting strength. Aircraft aluminum has been used with success. The legs may also be made of wood, carbon fiber, structural metals such as steel, etc. However, it is desirable to employ a material which is not unduly heavy in the event that the portable platform is intended to be lightweight. Posts, when present, may be comprised of similar materials as deemed appropriate, which materials have sufficient structural stability to adequately support the legs.

When folded, the platform of the present invention has reduced storage requirements. The folded platform is compact, and may be stored in a fanny pack, or stored in pants hip pocket, as shown in FIGS. 3-5, 9, 10, 17 and 25, for instance. The platform of the present invention is accordingly easy to use, easy to transport, and easy to store.

The above description is not intended to be limiting, but merely representative of the various embodiments of the present invention, as various modifications may be made therein which are still within the intended scope of the invention.

What is claimed is:

1. A portable collapsible platform having at least three outwardly-inclined legs and a platform supported thereby, said platform being comprised of dimensionally-stable foldable sections, said legs each having multiple connectable sections, an uppermost portion of each of said legs being adapted to be removably attached at a centrally-positioned location at the underside of said platform, whereby said legs extend from said centrally-positioned location outwardly therefrom in a supporting relationship to said platform, wherein said uppermost sections of said legs supportingly engage posts extending outwardly at said centrally-positioned location, said legs being maintained in biased relationship to said posts at the underside of said platform and the sections of said legs in biased relationship to each other by an elastic cord or cable which extends between said underside of said platform and a lowermost section of said legs, with said elastic cord or cable extending through each said respective sections of said legs and fixed to said lowermost section of each of said at least three outwardly-inclined legs, said elastic cord or cable being tensioned such that said sections of said legs while in assembled position being biased toward the underside of said platform and maintained in supporting relationship to each other, and said legs stored in a non-supporting position by separating said sections of each leg from one another by extension of said elastic cord or cable, and said separated sections of each leg placed onto an uppermost surface of said platform.

2. The portable platform of claim 1, wherein said posts are attached to the bottom of a swivel member rotatably attached to the bottom of said platform.

3. The portable platform of claim 2, wherein said legs are outwardly inclined from said centrally-positioned location at an angle of approximately 15 to 20 degrees to the vertical axis.

4. The portable platform of claim 2, wherein said foldable platform is comprised of three foldable sections, with the outermost foldable sections being adapted to fold inwardly toward an uppermost surface of said platform and in encompassing relationship to a middle section of said platform.

5. The portable platform of claim 2, wherein said dimensionally-stable foldable sections are hinged with respect to each other.

6. The portable platform of claim 1, wherein said legs are outwardly inclined from said centrally-positioned location at an angle of approximately 15 to 20 degrees to the vertical axis.

7. The portable platform of claim 1, wherein said foldable platform is comprised of three foldable sections, with the outermost foldable sections being adapted to fold inwardly toward an uppermost surface of said platform and in encompassing relationship to a middle section of said platform.

8. The portable platform of claim 1, wherein said dimensionally-stable foldable sections are hinged with respect to each other.

9. A portable collapsible platform having at least three outwardly-inclined legs and a platform supported thereby, said platform being comprised of dimensionally-stable foldable sections, said legs each having multiple connectable sections, an uppermost portion of each of said legs being adapted to be removably attached at a centrally-positioned location at the underside of said platform, whereby said legs extend from said centrally-positioned location outwardly therefrom in a supporting relationship to said platform, said legs being maintained in biased relationship to said underside of said platform and the sections of said legs in biased relationship to each other by an elastic cord or cable which extends between said underside of said platform and a lowermost section of said legs, with said elastic cord or cable extending through each said respective sections of said legs and fixed to said lowermost section of each of said at least three outwardly-inclined legs, said elastic cord or cable being tensioned such that said sections of said legs while in assembled position being biased toward the underside of said platform and maintained in supporting relationship to each other, said legs stored in a non-supporting position by separating said sections of each leg from one another by extension of said elastic cord or cable, and said separated sections of each leg placed onto an uppermost surface of said platform, and further including an elongated back-supporting member connected by hinge means to an end of a centrally-positioned foldable section of said platform, said back-supporting member movable from a storage position whereby said back-supporting member is folded downwardly upon said centrally-positioned foldable section to a substantially-vertical back-supporting position.

10. The portable platform of claim 9, wherein a portion of said elastic cord or cable opposite to that which is attached to a lowermost section of each of said three outwardly-inclined legs being extendable from said centrally-positioned location downwardly along the exterior of said legs, each of said legs including on an outside surface thereof means to removably fix said elastic cord or cable when in an extended state thereon whereby, when said elastic cord or cable is removably fixed to said outside surface of each respective leg, said legs are caused to be biased toward said platform when in said biased relationship to one another.

11. The portable platform of claim 9, wherein said uppermost sections of said legs are attached to a swivel member rotatably attached to the bottom of said platform.

12. The portable platform of claim 11, wherein a portion of said elastic cord or cable opposite to that which is attached to a lowermost section of each of said three outwardly-inclined legs being extendable from said centrally-positioned location downwardly along the exterior of said legs, each of said legs including on an outside surface thereof means to removably fix said elastic cord or cable when in an extended state thereon whereby, when said elastic cord or cable is removably fixed to said outside surface of each respective leg, said legs are caused to be biased toward said platform when in said biased relationship to one another.

13. The portable platform of claim 9, wherein said uppermost sections of said legs are engaged within corresponding-sized outwardly-angled holes at said centrally-positioned location.

14. The portable platform of claim 13, wherein said outwardly-angled holes are present in a swivel member rotatably attached to the bottom of said platform.

15. The portable platform of claim 14, wherein a portion of said elastic cord or cable opposite to that which is attached to a lowermost section of each of said three outwardly-inclined legs being extendable from said centrally-positioned location downwardly along the exterior of said legs, each of said legs including on an outside surface thereof means to removably fix said elastic cord or cable when in an extended state thereon whereby, when said elastic cord or cable is removably fixed to said outside surface of each respective leg, said legs are caused to be biased toward said platform when in said biased relationship to one another.

16. The portable platform of claim 9, wherein said uppermost sections of said legs are engaged in a supporting relationship with posts extending outwardly at said centrally-positioned location.

17. The portable platform of claim 16, wherein said posts are attached to the bottom of a swivel member rotatably attached to the bottom of said platform.

18. The portable platform of claim 17, wherein a portion of said elastic cord or cable opposite to that which is attached to a lowermost section of each of said three outwardly-inclined legs being extendable from said centrally-positioned location downwardly along the exterior of said legs, each of said legs including on an outside surface thereof means to removably fix said elastic cord or cable when in an extended state thereon whereby, when said elastic cord or cable is removably fixed to said outside surface of each respective leg, said legs are caused to be biased toward said platform when in said biased relationship to one another.

19. The portable platform of claim 9, wherein said legs are outwardly inclined from said centrally-positioned location at an angle of approximately 15 to 20 degrees to the vertical axis.

20. The portable platform of claim 9, wherein said foldable platform is comprised of three foldable sections, with the outermost foldable sections being adapted to fold inwardly toward an uppermost surface of said platform and in encompassing relationship to a middle section of said platform.

21. The portable platform of claim 9, wherein said dimensionally-stable foldable sections are hinged with respect to each other.

22. A portable collapsible platform having at least three outwardly-inclined legs and a platform supported thereby, said platform being comprised of dimensionally-stable foldable sections, said legs each having multiple connectable sections, an uppermost portion of each of said legs being adapted to be removably attached at a centrally-positioned location at the underside of said platform, whereby said legs extend from said centrally-positioned location outwardly therefrom in a supporting relationship to said platform, said legs being maintained in biased relationship to said underside of said platform and the sections of said legs in biased relationship to each other by an elastic cord or cable which extends between said underside of said platform and a lowermost section of said legs, with said elastic cord or cable extending through each said respective sections of said legs and fixed to said lowermost section of each of said at least three outwardly-inclined legs, said elastic cord or cable being tensioned such that said sections of said legs while in assembled position being biased toward the underside of said platform and maintained in supporting relationship to each other, said legs stored in a non-supporting position by separating said sections of each leg from one another by extension of said elastic cord or cable, and said separated sections of each leg placed onto an uppermost surface of said platform, and wherein a portion of said elastic cord or cable opposite to that which is attached to a lowermost section of each of said three outwardly-inclined legs being extendable from said centrally-positioned location downwardly along the exterior of said legs, each of said legs including on an outside surface thereof means to removably fix said elastic cord or cable when in an extended state thereon whereby, when said elastic cord or cable is removably fixed to said outside surface of each respective leg, said legs are caused to be biased toward said platform when in said biased relationship to one another.

23. The portable platform of claim 22, wherein said uppermost sections of said legs are attached to a swivel member rotatably attached to the bottom of said platform.

24. The portable platform of claim 22, wherein said uppermost sections of said legs are engaged within corresponding-sized outwardly-angled holes at said centrally-positioned location.

25. The portable platform of claim 24, wherein said outwardly-angled holes are present in a swivel member rotatably attached to the bottom of said platform.

26. The portable platform of claim 22, wherein said uppermost sections of said legs are engaged in supporting relationship with posts extending outwardly at said centrally-positioned location.

27. The portable platform of claim 26, wherein said posts are attached to the bottom of a swivel member rotatably attached to the bottom of said platform.

28. The portable platform of claim 22, wherein said legs are outwardly inclined from said centrally-positioned location at an angle of approximately 15 to 20 degrees to the vertical axis.

29. The portable platform of claim 22, wherein said foldable platform is comprised of three foldable sections, with the outermost foldable sections being adapted to fold inwardly toward an uppermost surface of said platform and in encompassing relationship to a middle section of said platform.

30. The portable platform of claim 22, wherein said dimensionally-stable foldable sections are hinged with respect to each other.

* * * * *